US011309624B2

(12) United States Patent
Gibson et al.

(10) Patent No.: US 11,309,624 B2
(45) Date of Patent: Apr. 19, 2022

(54) NOZZLE CAP ENCAPSULATED ANTENNA SYSTEM

(71) Applicant: Mueller International, LLC, Atlanta, GA (US)

(72) Inventors: Daryl Lee Gibson, Cleveland, TN (US); William Mark O'Brien, Toronto (CA); Andrew Wallace, Richmond Hill (CA); David James Carlos Dunn, Limehouse (CA); Spencer L. Webb, Windham, NH (US); Lian Jie Zhao, North York (CA); Igor Gorban, Oakville (CA); Mohammad Hassan Sobhani, Burlington (CA)

(73) Assignee: Mueller International, LLC, Atlanta, GA (US)

( * ) Notice: Subject to any disclaimer, the term of this patent is extended or adjusted under 35 U.S.C. 154(b) by 205 days.

(21) Appl. No.: 16/234,715

(22) Filed: Dec. 28, 2018

(65) Prior Publication Data

US 2020/0212549 A1 Jul. 2, 2020

(51) Int. Cl.
*H01Q 1/38* (2006.01)
*H01Q 1/44* (2006.01)
(Continued)

(52) U.S. Cl.
CPC ..... *H01Q 1/38* (2013.01); *E03B 9/02* (2013.01); *H01Q 1/44* (2013.01); *H01Q 5/35* (2015.01); *H01Q 21/0006* (2013.01); *H01Q 1/42* (2013.01)

(58) Field of Classification Search
CPC .. H01Q 1/38; H01Q 1/44; H01Q 5/35; H01Q 21/0006; H01Q 1/42; H01Q 9/42;
(Continued)

(56) References Cited

U.S. PATENT DOCUMENTS 1,738,094 A 12/1929 Caldwell
2,171,173 A 8/1939 Coyer
(Continued)

FOREIGN PATENT DOCUMENTS

AU 2011265675 5/2015
AU 2015202550 11/2017
(Continued)

OTHER PUBLICATIONS

Gibson, Daryl Lee; Non-Final Office Action for U.S. Appl. No. 15/255,795, filed Sep. 2, 2016, dated Feb. 23, 2018, 86 pgs.
(Continued)

*Primary Examiner* — Dimary S Lopez Cruz
*Assistant Examiner* — Bamidele A Jegede
(74) *Attorney, Agent, or Firm* — Taylor English Duma LLP

(57) ABSTRACT

A nozzle cap includes a cap body defining a first body end and a second body end, the cap body defining a circumferential wall extending from the first body end towards the second body end; an antenna cover circumferentially overlapping a portion of the circumferential wall, the antenna cover defining an inner cover surface facing the circumferential wall, an antenna cavity defined between the inner cover surface and the portion of the circumferential wall; and an antenna printed circuit board ("PCB") strip positioned within the antenna cavity, the antenna PCB strip secured in facing engagement with the inner cover surface.

19 Claims, 10 Drawing Sheets

(51) Int. Cl.

| | |
|---|---|
| ***H01Q 5/35*** | (2015.01) |
| ***E03B 9/02*** | (2006.01) |
| ***H01Q 21/00*** | (2006.01) |
| *H01Q 1/42* | (2006.01) |

(58) Field of Classification Search
CPC ..... H01Q 7/00; H01Q 9/0442; H01Q 1/241; E03B 9/02; E03B 9/06; E03B 9/04
See application file for complete search history.

(56) References Cited

U.S. PATENT DOCUMENTS 3,254,528 A 6/1966 Michael
3,592,967 A 7/1971 Harris
3,612,922 A 10/1971 Furnival
3,662,600 A 5/1972 Rosano, Jr. et al.
3,673,856 A 7/1972 Panigati
3,815,129 A 6/1974 Sweany
4,000,753 A 1/1977 Ellis
4,056,970 A 11/1977 Sollish
4,083,229 A 4/1978 Anway
4,333,028 A 6/1982 Panton
4,431,873 A 2/1984 Dunn et al.
4,462,249 A 7/1984 Adams
4,467,236 A 8/1984 Kolm et al.
4,543,817 A 10/1985 Sugiyama
4,796,466 A 1/1989 Farmer
4,844,396 A 7/1989 Norton
4,930,358 A 6/1990 Motegi et al.
4,984,498 A 1/1991 Fishman
5,038,614 A 8/1991 Bseisu
5,052,215 A 10/1991 Lewis
5,078,006 A 1/1992 Maresca et al.
5,085,082 A 2/1992 Cantor et al.
5,090,234 A 2/1992 Maresca et al.
5,117,676 A 6/1992 Chang
5,118,464 A 6/1992 Richardson et al.
5,163,314 A 11/1992 Maresca et al.
5,165,280 A 11/1992 Sternberg et al.
5,170,657 A 12/1992 Maresca et al.
5,174,155 A 12/1992 Sugimoto
5,187,973 A 2/1993 Kunze et al.
5,189,904 A 3/1993 Maresca et al.
5,201,226 A 4/1993 John et al.
5,203,202 A 4/1993 Spencer
5,205,173 A 4/1993 Allen
5,209,125 A 5/1993 Kalinoski et al.
5,218,859 A 6/1993 Stenstrom et al.
5,243,862 A 9/1993 Latimer
5,254,944 A 10/1993 Holmes et al.
5,272,646 A 12/1993 Farmer
5,279,160 A 1/1994 Koch
5,287,884 A 2/1994 Cohen
5,298,894 A 3/1994 Cerny et al.
5,301,985 A 4/1994 Terzini
5,303,592 A 4/1994 Livingston
5,319,956 A 6/1994 Bogle et al.
5,333,501 A 8/1994 Okada et al.
5,335,547 A 8/1994 Nakajima et al.
5,343,737 A 9/1994 Baumoel
5,349,568 A 9/1994 Kupperman et al.
5,351,655 A 10/1994 Nuspl
5,361,636 A 11/1994 Farstad et al.
5,367,911 A 11/1994 Jewell et al.
5,385,049 A 1/1995 Hunt et al.
5,396,800 A 3/1995 Drinon et al.
5,408,883 A 4/1995 Clark et al.
5,416,724 A 5/1995 Savic
5,461,906 A 10/1995 Bogle et al.
5,519,184 A 5/1996 Umlas
5,526,691 A 6/1996 Latimer et al.
5,531,099 A 7/1996 Russo
5,548,530 A 8/1996 Baumoel
5,581,037 A 12/1996 Kwun et al.
5,591,912 A 1/1997 Spisak et al.
5,602,327 A 2/1997 Torizuka et al.
5,611,948 A 3/1997 Hawkins
5,619,423 A 4/1997 Scrantz
5,623,203 A 4/1997 Hosohara et al.
5,633,467 A 5/1997 Paulson
5,639,958 A 6/1997 Lange
5,655,561 A 8/1997 Wendel et al.
5,686,828 A 11/1997 Peterman et al.
5,708,211 A 1/1998 Jepson et al.
5,746,611 A * 5/1998 Brown ..... H01R 13/5213 439/135
5,754,101 A 5/1998 Tsunetomi et al.
5,760,306 A 6/1998 Wyatt et al.
5,789,720 A 8/1998 Lagally et al.
5,798,457 A 8/1998 Paulson
5,838,633 A 11/1998 Sinha
5,866,820 A 2/1999 Camplin et al.
5,892,163 A 4/1999 Johnson
5,898,412 A * 4/1999 Jones ..... H01Q 1/02 343/872
5,907,100 A 5/1999 Cook
5,965,818 A 10/1999 Wang
5,970,434 A 10/1999 Brophy et al.
5,974,862 A 11/1999 Lander
5,987,990 A 11/1999 Worthington et al.
6,000,277 A 12/1999 Smith
6,000,288 A 12/1999 Kwun et al.
6,003,376 A 12/1999 Burns et al.
6,023,986 A 2/2000 Smith et al.
6,035,717 A 3/2000 Carodiskey
6,058,957 A 5/2000 Honigsbaum
6,076,407 A 6/2000 Levesque et al.
6,082,193 A 7/2000 Paulson
6,089,253 A * 7/2000 Stehling ..... E03B 9/10 137/296
6,102,444 A 8/2000 Kozey
6,104,349 A 8/2000 Cohen
6,125,703 A 10/2000 MacLauchlan et al.
6,127,823 A 10/2000 Atherton
6,127,987 A 10/2000 Maruyama et al.
6,138,512 A 10/2000 Roberts
6,138,514 A 10/2000 Iwamoto et al.
6,164,137 A 12/2000 Hancock et al.
6,170,334 B1 1/2001 Paulson
6,175,380 B1 1/2001 Van Den Bosch
6,181,294 B1 1/2001 Porter et al.
6,192,352 B1 2/2001 Alouani et al.
6,243,657 B1 6/2001 Tuck et al.
6,267,000 B1 7/2001 Harper et al.
6,276,213 B1 8/2001 Lee et al.
6,296,066 B1 10/2001 Terry
6,343,510 B1 2/2002 Neeson et al.
6,363,788 B1 4/2002 Gorman et al.
6,389,881 B1 5/2002 Yang et al.
6,401,525 B1 6/2002 Jamieson
6,404,343 B1 6/2002 Andou et al.
6,442,999 B1 9/2002 Baumoel
6,450,542 B1 9/2002 McCue
6,453,247 B1 9/2002 Hunaidi
6,470,749 B1 10/2002 Han et al.
6,530,263 B1 3/2003 Chana
6,561,032 B1 5/2003 Hunaidi
6,567,006 B1 5/2003 Lander et al.
6,578,422 B2 6/2003 Lam et al.
6,595,038 B2 7/2003 Williams et al.
6,606,059 B1 * 8/2003 Barabash ..... H01Q 3/24 343/700 MS
6,624,628 B1 9/2003 Kwun et al.
6,647,762 B1 11/2003 Roy
6,651,503 B2 11/2003 Bazarov et al.
6,666,095 B2 12/2003 Thomas et al.
6,667,709 B1 12/2003 Hansen et al.
6,707,762 B1 3/2004 Goodman et al.
6,710,600 B1 3/2004 Kopecki et al.
6,725,705 B1 4/2004 Huebler et al.
6,734,674 B1 5/2004 Struse
6,745,136 B2 6/2004 Lam et al.
6,751,560 B1 6/2004 Tingley et al.
6,763,730 B1 7/2004 Wray

(56) References Cited

U.S. PATENT DOCUMENTS 6,772,636 B2 8/2004 Lam et al.
6,772,637 B2 8/2004 Bazarov et al.
6,772,638 B2 8/2004 Matney et al.
6,781,369 B2 8/2004 Paulson et al.
6,782,751 B2 8/2004 Linares et al.
6,789,427 B2 9/2004 Batzinger et al.
6,791,318 B2 9/2004 Paulson et al.
6,799,455 B1 10/2004 Neefeldt et al.
6,799,466 B2 10/2004 Chinn
6,813,949 B2 11/2004 Masaniello et al.
6,813,950 B2 11/2004 Glascock et al.
6,816,072 B2 11/2004 Zoratti
6,820,016 B2 11/2004 Brown et al.
6,822,742 B1 11/2004 Kalayeh et al.
6,843,131 B2 1/2005 Graff et al.
6,848,313 B2 2/2005 Krieg et al.
6,851,319 B2 2/2005 Ziola et al.
6,889,703 B2 5/2005 Bond
6,904,818 B2 6/2005 Harthorn et al.
6,912,472 B2 6/2005 Mizushina et al.
6,920,792 B2 7/2005 Flora et al.
6,931,931 B2 8/2005 Graff et al.
6,935,178 B2 8/2005 Prause
6,945,113 B2 9/2005 Siverling et al.
6,957,157 B2 10/2005 Lander
6,968,727 B2 11/2005 Kwun et al.
6,978,832 B2 12/2005 Gardner et al.
7,051,577 B2 5/2006 Komninos
7,080,557 B2 7/2006 Adnan
7,109,929 B1 9/2006 Ryken, Jr.
7,111,516 B2 9/2006 Bazarov et al.
7,140,253 B2 11/2006 Merki et al.
7,143,659 B2 12/2006 Stout et al.
7,171,854 B2 2/2007 Nagashima et al.
7,231,331 B2 6/2007 Davis
7,234,355 B2 6/2007 Dewangan et al.
7,240,574 B2 7/2007 Sapelnikov
7,255,007 B2 8/2007 Messer et al.
7,261,002 B1 8/2007 Gysling et al.
7,266,992 B2 9/2007 Shamout et al.
7,274,996 B2 9/2007 Lapinski
7,284,433 B2 10/2007 Mes et al.
7,293,461 B1 11/2007 Girndt
7,299,697 B2 11/2007 Siddu et al.
7,310,877 B2 12/2007 Cao et al.
7,328,618 B2 2/2008 Hunaidi
7,331,215 B2 2/2008 Bond
7,356,444 B2 4/2008 Blemel
7,360,462 B2 4/2008 Nozaki et al.
7,373,808 B2 5/2008 Zanker et al.
7,380,466 B2 6/2008 Deeg
7,383,721 B2 6/2008 Parsons et al.
7,392,709 B2 7/2008 Eckert
7,405,391 B2 7/2008 Ogisu et al.
7,412,882 B2 8/2008 Lazar et al.
7,412,890 B1 8/2008 Johnson et al.
7,414,395 B2 8/2008 Gao et al.
7,426,879 B2 9/2008 Nozaki et al.
7,458,267 B2 12/2008 McCoy
7,475,596 B2 1/2009 Hunaidi et al.
7,493,817 B2 2/2009 Germata
7,523,666 B2 4/2009 Thompson et al.
7,526,944 B2 5/2009 Sabata et al.
7,530,270 B2 5/2009 Nozaki et al.
7,543,500 B2 6/2009 Litzenberg et al.
7,554,345 B2 6/2009 Vokey
7,564,540 B2 7/2009 Paulson
7,587,942 B2 9/2009 Smith et al.
7,590,496 B2 9/2009 Blemel
7,596,458 B2 9/2009 Lander
7,607,351 B2 10/2009 Allison et al.
7,623,427 B2 11/2009 Jann et al.
7,647,829 B2 1/2010 Junker et al.
7,650,790 B2 1/2010 Wright
7,657,403 B2 2/2010 Stripf et al.
7,668,670 B2 2/2010 Lander
7,680,625 B2 3/2010 Trowbridge et al.
7,690,258 B2 4/2010 Minagi et al.
7,694,564 B2 4/2010 Brignac et al.
7,696,940 B1 4/2010 MacDonald
7,711,217 B2 5/2010 Takahashi et al.
7,751,989 B2 7/2010 Owens et al.
7,810,378 B2 10/2010 Hunaidi et al.
8,319,508 B2 11/2012 Vokey
8,353,309 B1 1/2013 Embry et al.
8,614,745 B1 12/2013 Al Azemi
8,657,021 B1 * 2/2014 Preta ..... H04Q 9/00 169/61
8,668,206 B2 3/2014 Ball
8,674,830 B2 3/2014 Lanham et al.
8,823,509 B2 9/2014 Hyland et al.
8,843,241 B2 9/2014 Saberi et al.
8,931,505 B2 1/2015 Hyland et al.
9,053,519 B2 6/2015 Scolnicov et al.
9,291,520 B2 3/2016 Fleury, Jr. et al.
9,315,973 B2 4/2016 Varman et al.
9,496,943 B2 11/2016 Parish et al.
9,528,903 B2 12/2016 Zusman
9,562,623 B2 2/2017 Clark
9,593,999 B2 3/2017 Fleury
9,772,250 B2 9/2017 Richarz et al.
9,780,433 B2 10/2017 Schwengler et al.
9,799,204 B2 10/2017 Hyland et al.
9,849,322 B2 12/2017 Hyland et al.
9,861,848 B2 1/2018 Hyland et al.
9,970,805 B2 5/2018 Cole et al.
10,175,135 B2 1/2019 Dintakurt et al.
10,283,857 B2 5/2019 Ortiz et al.
10,305,178 B2 5/2019 Gibson et al.
10,317,384 B2 6/2019 Morrow et al.
10,386,257 B2 8/2019 Fleury, Jr. et al.
10,857,403 B2 12/2020 Hyland et al.
10,859,462 B2 12/2020 Gibson et al.
10,881,888 B2 1/2021 Hyland et al.
11,047,761 B1 6/2021 Frackelton et al.
2001/0045129 A1 11/2001 Williams et al.
2002/0043549 A1 4/2002 Taylor et al.
2002/0124633 A1 9/2002 Yang
2002/0159584 A1 10/2002 Sindalovsky et al.
2003/0107485 A1 * 6/2003 Zoratti ..... E03B 9/04 340/568.1
2003/0193193 A1 10/2003 Harrington et al.
2004/0129312 A1 7/2004 Cuzzo et al.
2004/0173006 A1 9/2004 McCoy et al.
2004/0201215 A1 10/2004 Steingass
2005/0005680 A1 1/2005 Anderson
2005/0067022 A1 3/2005 Istre
2005/0072214 A1 4/2005 Cooper
2005/0121880 A1 6/2005 Santangelo
2005/0153586 A1 * 7/2005 Girinon ..... B64D 45/02 439/92
2005/0279169 A1 12/2005 Lander
2006/0174707 A1 8/2006 Zhang
2006/0201550 A1 9/2006 Blyth et al.
2006/0283251 A1 12/2006 Hunaidi
2006/0284784 A1 * 12/2006 Smith ..... G01D 4/008 343/872
2007/0044552 A1 3/2007 Huang
2007/0051187 A1 3/2007 McDearmon
2007/0113618 A1 5/2007 Yokoi et al.
2007/0130317 A1 6/2007 Lander
2008/0078567 A1 4/2008 Miller et al.
2008/0079640 A1 4/2008 Yang
2008/0168840 A1 7/2008 Seeley et al.
2008/0189056 A1 8/2008 Heidl et al.
2008/0238711 A1 * 10/2008 Payne ..... G01D 4/008 340/870.02
2008/0281534 A1 11/2008 Hurley
2008/0307623 A1 12/2008 Furukawa
2008/0314122 A1 12/2008 Hunaidi
2009/0044628 A1 2/2009 Lotscher
2009/0133887 A1 5/2009 Garcia
2009/0139336 A1 6/2009 Trowbridge, Jr. et al.
2009/0182099 A1 7/2009 Noro et al.

(56) References Cited

U.S. PATENT DOCUMENTS

| | | | | |
|---|---|---|---|---|
| 2009/0214941 | A1 | 8/2009 | Buck et al. | |
| 2009/0278293 | A1 | 11/2009 | Yoshinaka et al. | |
| 2009/0301571 | A1* | 12/2009 | Ruhs | F16K 35/16 137/296 |
| 2010/0077234 | A1 | 3/2010 | Das | |
| 2010/0156632 | A1 | 6/2010 | Hyland et al. | |
| 2010/0290201 | A1 | 11/2010 | Takeuchi et al. | |
| 2010/0295672 | A1* | 11/2010 | Hyland | H04Q 9/00 340/539.1 |
| 2011/0063172 | A1* | 3/2011 | Podduturi | H01Q 1/38 343/700 MS |
| 2011/0066297 | A1 | 3/2011 | Saberi | |
| 2011/0079402 | A1 | 4/2011 | Darby et al. | |
| 2011/0102281 | A1 | 5/2011 | Su | |
| 2011/0162463 | A1* | 7/2011 | Allen | G01F 1/662 73/861.18 |
| 2011/0308638 | A1* | 12/2011 | Hyland | E03B 9/06 137/299 |
| 2012/0007743 | A1 | 1/2012 | Solomon | |
| 2012/0007744 | A1 | 1/2012 | Pal et al. | |
| 2012/0169560 | A1 | 7/2012 | Lee et al. | |
| 2012/0296580 | A1 | 11/2012 | Barkay | |
| 2012/0324985 | A1 | 12/2012 | Gu et al. | |
| 2013/0036796 | A1* | 2/2013 | Fleury, Jr. | H01Q 1/38 73/40.5 R |
| 2013/0041601 | A1 | 2/2013 | Dintakurti et al. | |
| 2013/0049968 | A1* | 2/2013 | Fleury, Jr. | G01M 3/243 340/605 |
| 2013/0145826 | A1 | 6/2013 | Richarz et al. | |
| 2013/0211797 | A1 | 8/2013 | Scolnicov | |
| 2013/0229262 | A1 | 9/2013 | Bellows | |
| 2013/0298664 | A1 | 11/2013 | Gillette, II et al. | |
| 2013/0321231 | A1 | 12/2013 | Flores-Cuadras | |
| 2014/0206210 | A1* | 7/2014 | Ritner | H01R 12/771 439/84 |
| 2014/0225787 | A1* | 8/2014 | Ramachandran | H01Q 9/42 343/702 |
| 2014/0373941 | A1* | 12/2014 | Varman | E03B 9/06 137/296 |
| 2015/0070221 | A1 | 3/2015 | Schwengler et al. | |
| 2015/0082868 | A1 | 3/2015 | Hyland | |
| 2015/0128714 | A1* | 5/2015 | Moss | H02J 50/10 73/726 |
| 2016/0001114 | A1 | 1/2016 | Hyland | |
| 2016/0013565 | A1 | 1/2016 | Ortiz | |
| 2016/0018283 | A1 | 1/2016 | Fleury | |
| 2016/0097696 | A1 | 4/2016 | Zusman | |
| 2017/0072238 | A1 | 3/2017 | Silvers et al. | |
| 2017/0121949 | A1 | 5/2017 | Fleury | |
| 2017/0237158 | A1* | 8/2017 | Gibson | H01Q 1/44 343/872 |
| 2017/0237165 | A1* | 8/2017 | Ortiz | H01Q 21/30 343/872 |
| 2018/0080849 | A1 | 3/2018 | Showcatally et al. | |
| 2018/0093117 | A1 | 4/2018 | Hyland | |
| 2018/0224349 | A1 | 8/2018 | Fleury, Jr. et al. | |
| 2019/0024352 | A1 | 1/2019 | Ozburn | |
| 2019/0214717 | A1 | 7/2019 | Gibson et al. | |
| 2019/0214718 | A1 | 7/2019 | Ortiz et al. | |
| 2019/0316983 | A1 | 10/2019 | Fleury, Jr. et al. | |
| 2020/0069987 | A1 | 3/2020 | Hyland et al. | |
| 2020/0072697 | A1 | 3/2020 | Gibson et al. | |
| 2020/0232863 | A1 | 7/2020 | Moreno et al. | |
| 2020/0232864 | A1 | 7/2020 | Moreno et al. | |
| 2020/0378859 | A1 | 12/2020 | Gibson et al. | |
| 2021/0023408 | A1* | 1/2021 | Hyland | F17D 5/00 |
| 2021/0041323 | A1 | 2/2021 | Gibson et al. | |
| 2021/0247261 | A1 | 8/2021 | Gibson et al. | |
| 2021/0249765 | A1 | 8/2021 | Ortiz et al. | |
| 2021/0355661 | A1 | 11/2021 | Gibson et al. | |

FOREIGN PATENT DOCUMENTS

| | | |
|---|---|---|
| AU | 2017248541 | 3/2019 |
| CA | 2154433 | 1/1997 |
| CA | 2397174 | 8/2008 |
| CA | 2634739 | 6/2015 |
| CA | 3010333 | 7/2020 |
| CA | 2766850 | 8/2020 |
| CA | 3023529 | 8/2020 |
| CA | 3070690 | 11/2020 |
| CA | 2842042 | 1/2021 |
| CA | 3057167 | 3/2021 |
| CA | 3057202 | 5/2021 |
| CA | 3060512 | 6/2021 |
| CA | 3010345 | 7/2021 |
| CN | 1831478 | 6/2013 |
| DE | 4211038 | 10/1993 |
| DE | 19757581 | 7/1998 |
| EP | 0711986 | 5/1996 |
| EP | 1052492 | 11/2000 |
| EP | 1077370 | 2/2001 |
| EP | 1077371 | 2/2001 |
| FR | 2439990 | 5/1980 |
| GB | 2250820 | 6/1992 |
| GB | 2269900 | 2/1994 |
| GB | 2367362 | 4/2002 |
| GB | 2421311 | 6/2006 |
| GB | 2550908 | 12/2017 |
| JP | 59170739 | 9/1984 |
| JP | 60111132 | 6/1985 |
| JP | 08250777 | 9/1996 |
| JP | H10-2744 | 1/1998 |
| JP | 11201859 | 7/1999 |
| JP | H11210028 | 8/1999 |
| JP | 2000131179 | 5/2000 |
| JP | 2002206965 | 7/2002 |
| JP | 2002310840 | 10/2002 |
| JP | 2005315663 | 11/2005 |
| JP | 2005321935 | 11/2005 |
| JP | 2006062414 | 3/2006 |
| JP | 2006062716 | 3/2006 |
| JP | 2007047139 | 2/2007 |
| JP | 2010068017 | 3/2010 |
| JP | 2013528732 | 7/2013 |
| JP | H5654124 | 11/2017 |
| KR | 101785664 | 11/2017 |
| WO | 9850771 | 11/1998 |
| WO | 0151904 | 7/2001 |
| WO | 03049528 | 6/2003 |
| WO | 2004073115 | 8/2004 |
| WO | 2009057214 | 5/2009 |
| WO | 2010135587 | 11/2010 |
| WO | 2011021039 | 2/2011 |
| WO | 2011058561 | 5/2011 |
| WO | 2011159403 | 12/2011 |
| WO | 2012000088 | 1/2012 |
| WO | 2012153147 | 11/2012 |
| WO | 2013025526 | 2/2013 |
| WO | 2014016625 | 1/2014 |
| WO | 2017139029 | 8/2017 |
| WO | 2017139030 | 8/2017 |
| WO | 2020050946 | 3/2020 |
| WO | 2021231163 | 11/2021 |

OTHER PUBLICATIONS

Gibson, Daryl Lee; International Preliminary Report on Patentability for PCT Application No. PCT/US2016/067692, filed Dec. 20, 2016, dated Aug. 23, 2018, 9 pgs.

Gibson, Daryl Lee; International Search Report and Written Opinion for PCT Application No. PCT/US2016/067692, filed Dec. 20, 2016, dated Mar. 2, 2017,10 pgs.

Gibson, Daryl Lee; U.S. Provisional Application entitled: Nozzle Cap Multi-Band Antenna Assembly having U.S. Appl. No. 62/294,973, filed Feb. 12, 2016, 54 pgs.

Hyland, Gregory E.; Non-Final Office Action for U.S. Appl. No. 15/817,172, filed Nov. 18, 2017, dated Jul. 10, 2019, 74 pgs.

(56) References Cited

OTHER PUBLICATIONS

Fleury, Jr., Leo W.; Corrected Notice of Allowance for U.S. Appl. No. 15/401,457, filed Jan. 9, 2017, dated Jun. 26, 2019, 55 pgs.
Hyland, Gregory E.; Non-Final Office Action for U.S. Appl. No. 16/675,507, filed Nov. 6, 2019, dated Jan. 28, 2020, 18 pgs.
Hyland, Gregory E.; Office Action for Canadian patent application No. 3,023,529, filed May 5, 2011, dated Nov. 26, 2019, 4 pgs.
Fleury, Leo W.; Office Action for Canadian patent application No. 2,842,042, filed Aug. 10, 2012, dated Dec. 5. 82019, 3 pgs.
Ortiz, Jorge Isaac; Office Action for Canadian patent application No. 3,010,333, filed Dec. 20, 2016, dated Dec. 6, 2019, 4 pgs.
Gibson, Daryl Lee; Office Action for Canadian patent application No. 3,010,345, filed Dec. 20, 2016, dated Dec. 16, 2019, 4 pgs.
Gibson, Daryl Lee; International Search Report and Written Opinion for PCT Application No. PCT/US19/45451, filed Aug. 7, 2019, dated Feb. 3, 2020, 11 pgs.
Gibson, Daryl Lee; Office Action for Canadian application No. 3,057,202, filed Oct. 1, 2019, dated Dec. 19, 2019, 3 pgs.
Hyland, Gregory E., Non-Final Office Action for U.S. Appl. No. 13/101,235, filed May 5, 2011, dated Jul. 31, 2013; 57 pgs.
Hyland, Gregory E.; Final Office Action for U.S. Appl. No. 13/101,235, filed May 5, 2011, dated Feb. 20, 2014; 29 pgs.
Hyland, Gregory E.; Issue Notification for U.S. Appl. No. 13/101,235, filed May 5, 2011, dated Dec. 23, 2014, 1 pg.
Hyland, Gregory E.; Non-Final Office Action for U.S. Appl. No. 13/101,235, filed May 5, 2011, dated Jun. 5, 2014, 29 pgs.
Hyland, Gregory E.; Notice of Allowance for U.S. Appl. No. 13/101,235, filed May 5, 2011, dated Sep. 11, 2014, 11 pgs.
Hyland, Gregory E.; Supplemental Notice of Allowability for U.S. Appl. No. 13/101,235, filed May 5, 2011, dated Nov. 25, 2014, 5 pgs.
Hyland, Gregory E.; Final Office Action for U.S. Appl. No. 14/557,754, filed Dec. 2, 2014, dated Jun. 30, 2016, 24 pgs.
Hyland, Gregory E.; Non-Final Office Action for U.S. Appl. No. 14/557,754, filed Dec. 2, 2014, dated Jan. 19, 2016, 101 pgs.
Hyland, Gregory E.; Notice of Allowance for U.S. Appl. No. 14/557,754, filed Dec. 2, 2014, dated Jul. 17, 2017, 14 pgs.
Hyland, Gregory E.; Notice of Decision from Post-Prosecution Pilot Program (P3) Conference for U.S. Appl. No. 14/557,754, filed Dec. 2, 2014, dated Sep. 14, 2016, 4 pgs.
Hyland, Gregory E.; Supplemental Notice of Allowability for U.S. Appl. No. 14/557,754, filed Dec. 2, 2014, dated Oct. 20, 2017, 11 pgs.
Hyland, Gregory; Issue Notification for U.S. Appl. No. 14/557,754, filed Dec. 2, 2014, dated Dec. 20, 2017, 1 pg.
Hyland, Gregory E.; Applicant-Initiated Interview Summary for U.S. Appl. No. 14/557,754, filed Dec. 2, 2014, dated Apr. 19, 2017, 4 pgs.
Hyland, Gregory E.; Non-Final Office Action for U.S. Appl. No. 14/557,754, filed Dec. 2, 2014, dated Nov. 8, 2016, 48 pgs.
Hyland, Gregory E.; Final Office Action for U.S. Appl. No. 14/557,754, filed Dec. 2, 2014, dated Apr. 5, 2017, 23 pgs.
Hyland, Gregory E.; Non-Final Office Action for U.S. Appl. No. 14/848,676, filed Sep. 9, 2015, dated Dec. 13, 2016, 52 pgs.
Hyland, Gregory E.; Notice of Allowance for U.S. Appl. No. 14/848,676, filed Sep. 9, 2015, dated Sep. 6, 2017, 12 pgs.
Hyland, Gregory E.; Supplemental Notice of Allowability for U.S. Appl. No. 14/848,676, filed Sep. 9, 2015, dated Nov. 27, 2017, 6 pgs.
Hyland, Gregory E.; Supplemental Notice of Allowability for U.S. Appl. No. 14/848,676, filed Sep. 9, 2015, dated Sep. 19, 2017, 8 pgs.
Hyland, Gregory; Final Office Action for U.S. Appl. No. 14/848,676, filed Sep. 9, 2015, dated Jun. 7, 2017, 25 pgs.
Hyland, Gregory; Non-Final Office Action for U.S. Appl. No. 14/848,676, filed Sep. 9, 2015, dated Mar. 4, 2016, 94 pgs.
Hyland, Gregory E.; Final Office Action for U.S. Appl. No. 14/848,676, filed Sep. 9, 2015, dated Aug. 19, 2016; 20 pgs.
Fleury Jr., Leo W.; Non-Final Office Action for U.S. Appl. No. 13/492,790, filed Jun. 8, 2012, dated Nov. 5, 2014, 30 pgs.
Fleury, Jr., Leo W.; Advisory Action for U.S. Appl. No. 13/492,790, filed Jun. 8, 2012, dated Jul. 9, 2014, 3 pgs.
Fleury, Jr., Leo W.; Final Office Action for U.S. Appl. No. 13/492,790, filed Jun. 8, 2012, dated Mar. 12, 2014; 19 pgs.
Fleury, Jr., Leo W.; Issue Notification for U.S. Appl. No. 13/492,790, filed Jun. 8, 2012, dated Mar. 2, 2016, 1 pg.
Fleury, Jr., Leo W.; Non-Final Office Action for U.S. Appl. No. 13/492,790, filed Jun. 8, 2012, dated Sep. 12, 2013; 37 pgs.
Fleury, Jr., Leo W.; Notice of Allowance for U.S. Appl. No. 13/492,790, filed Jun. 8, 2012, dated Feb. 2, 2016, 9 pgs.
Fleury, Jr., Leo W.; Notice of Allowance for U.S. Appl. No. 13/492,790, filed Jun. 8, 2012, dated May 12, 2015, 9 pgs.
Fleury, Jr., Leo W.; Notice of Allowance for U.S. Appl. No. 13/492,790, filed Jun. 8, 2012, dated Sep. 23, 2015, 11 pgs.
Fleury, Leo W.; Applicant-Initiated Interview Summary for U.S. Appl. No. 14/870,070, filed Sep. 30, 2015, dated Feb. 28, 2018, 4 pgs.
Fleury, Leo W.; Final Office Action for U.S. Appl. No. 14/870,070, filed Sep. 30, 2015, dated Dec. 29, 2017, 24 pgs.
Fleury, Leo; Non-Final Office Action for U.S. Appl. No. 14/870,070, filed Sep. 30, 2015, dated Jun. 21, 2017, 88 pgs.
Richarz, Werner Guenther; Corrected Notice of Allowability for U.S. Appl. No. 13/492,792, filed Jun. 8, 2012, dated Aug. 29, 2017, 6 pgs.
Richarz, Werner Guenther; Final Office Action for U.S. Appl. No. 13/492,792, filed Jun. 8, 2012, dated Oct. 20, 2014, 17 pgs.
Richarz, Werner Guenther; Final Office Action for U.S. Appl. No. 13/492,792, filed Jun. 8, 2012, dated Sep. 10, 2015, 20 pgs.
Richarz, Werner Guenther; Final Office Action for U.S. Appl. No. 13/492,792, filed Jun. 8, 2012, dated Sep. 8, 2016, 36 pgs.
Richarz, Werner Guenther; Issue Notification for U.S. Appl. No. 13/492,792, filed Jun. 8, 2012, dated Sep. 6, 2017, 1 pg.
Richarz, Werner Guenther; Non-Final Office Action for U.S. Appl. No. 13/492,792, filed Jun. 8, 2012, dated Nov. 6, 2013, 39 pgs.
Richarz, Werner Guenther; Non-Final Office Action for U.S. Appl. No. 13/492,792, filed Jun. 8, 2012, dated Jun. 4, 2014, 24 pgs.
Richarz, Werner Guenther; Non-Final Office Action for U.S. Appl. No. 13/492,792, filed Jun. 8, 2012, dated Feb. 27, 2015, 15 pgs.
Richarz, Werner Guenther; Notice of Allowance for U.S. Appl. No. 13/492,792, filed Jun. 8, 2012, dated Jun. 13, 2017, 31 pgs.
Richarz, Werner Guenther; Restriction Requirement for U.S. Appl. No. 13/492,792, filed Jun. 8, 2012, dated Sep. 27, 2013; 5 pgs.
Richarz, Werner Guenther; Non-Final Office Action for U.S. Appl. No. 13/492,792, filed Jun. 8, 2012, dated Mar. 8, 2016, 27 pgs.
Chou, et al.; Article entitled: "Non-invasive Acceleration-based Methodology for Damage Detection and Assessment of Water Distribution System", Mar. 2010, 17 pgs.
Dintakurti, Ganapathi Deva Varma; Final Office Action for U.S. Appl. No. 13/492,794, filed Jun. 8, 2012, dated Oct. 18, 2017, 38 pgs.
Dintakurti, Ganapathi Deva Varma; Final Office Action for U.S. Appl. No. 13/492,794, filed Jun. 8, 2012, dated Nov. 8, 2016, 31 pgs.
Dintakurti, Ganapathi Deva Varma; Final Office Action for U.S. Appl. No. 13/492,794, filed Jun. 8, 2012, dated Jun. 22, 2018, 39 pgs.
Dintakurti, Ganapathi Deva Varma; Non-Final Office Action for U.S. Appl. No. 13/492,794, filed Jun. 8, 2012, dated Mar. 16, 2017, 30 pgs.
Dintakurti, Ganapathi Deva Varma; Non-Final Office Action for U.S. Appl. No. 13/492,794, filed Jun. 8, 2012, dated May 17, 2016, 48 pgs.
Antenna. Merriam-Webster Dictionary, 2014 [retrieved on Jun. 1, 2014]. Retrieved from the Internet: <URL: www.merriam-webster.com/dictionary/antenna>, 1 pg.
Hyland, Gregory E.; Issue Notification for U.S. Appl. No. 14/848,676, filed Sep. 9, 2015, dated Dec. 6, 2017, 1 pg.
"Non-Patent Literature Murata (entitled ""Piezoelectric Sounds Components""), accessed at http://web.archive.org/web/20030806141815/http://www.murata.com/catalog/p37e17.pdf, archived on Aug. 6, 2003.", 39 pgs.

(56) References Cited

OTHER PUBLICATIONS

"Non-Patent Literature NerdKits, accessed at http://web.archive.org/web/20090510051850/http://www.nerdkits.com/videos/sound_meter/, archived on May 10, 2009.", 6 pgs.
"Non-Patent Literature Bimorph (entitled ""Bimoprh actuators""), accessed at http://web.archive.org/web/20080122050424/http://www.elpapiezo.ru/eng/curve_e.shtml, archived on Jan. 22, 2008.", 3 pgs.
J.A. Gallego-Juarez, G. Rodriguez-Corral and L. Gaete-Garreton, An ultrasonic transducer for high power applications in gases, Nov. 1978, Ultrasonics, published by IPC Business Press, p. 267-271.
Dintakurti, Ganapathi Deva Varma; Non-Final Office Action for U.S. Appl. No. 13/492,794, filed Jun. 8, 2012, dated Jan. 11, 2018, 38 pgs.
Dintakurti, Ganapathi Deva Varma; Non-Final Office Action for U.S. Appl. No. 13/492,794, filed Jun. 8, 2012, dated Jan. 16, 2015, 60 pgs.
Fleury, Jr., Leo W.; Issue Notification for U.S. Appl. No. 13/492,795, filed Jun. 8, 2012, dated Feb. 22, 2017; 1 page.
Fleury, Jr., Leo W.; Corrected Notice of Allowability for U.S. Appl. No. 13/492,795, filed Jun. 8, 2012, dated Feb. 14, 2017; 8 pgs.
Fleury, Jr., Leo W.; Supplemental Notice of Allowance for U.S. Appl. No. 13/492,795, filed Jun. 8, 2012, dated Nov. 22, 2016; 8 pgs.
Fleury, Jr., Leo W.; Notice of Allowability for U.S. Appl. No. 13/492,795, filed Jun. 8, 2012, dated Oct. 24, 2016, 13 pgs.
Fleury, Jr., Leo W.; Notice of Allowance for U.S. Appl. No. 13/492,795, filed Jun. 8, 2012, dated Sep. 21, 2016, 18 pgs.
Fleury, Jr., Leo W.; Non-Final Office Action for U.S. Appl. No. 13/492,795, filed Jun. 8, 2012, dated Mar. 1, 2016, 42 pgs.
Fleury, Jr., Leo W.; Advisory Action for U.S. Appl. No. 13/492,795, filed Jun. 8, 2012, dated Sep. 9, 2015, 3 pgs.
Fleury, Jr., Leo W.; Final Office Action for U.S. Appl. No. 13/492,795, filed Jun. 8, 2012, dated May 22, 2015, 28 pgs.
Non-Patent Literature "Radiodetection Water Leak Detection Products", 2008, Radiodetection Ltd.—SPX Corporation, 12 pgs.
Fleury, Jr., Leo W.; Non-Final Office Action for U.S. Appl. No. 13/492,795, filed Jun. 8, 2012, dated Oct. 21, 2014, 37 pgs.
Fleury, Jr., Leo W.; Advisory Action for U.S. Appl. No. 13/492,795, filed Jun. 8, 2012, dated Jun. 18, 2014, 4 pgs.
Fleury, Jr., Leo W.; Final Office Action for U.S. Appl. No. 13/492,795, filed Jun. 8, 2012, dated Apr. 23, 2014, 19 pgs.
Fleury Jr., Leo W.; Non-Final Office Action for U.S. Appl. No. 13/492,795, filed Jun. 8, 2012, dated Sep. 23, 2013; 35 pgs.
Hyland; International Preliminary Report on Patentability for serial No. PCT/US2011/035374, filed May 5, 2011, dated Dec. 19, 2012; 5 pgs.
Hyland; International Search Report and Written Opinion for serial No. PCT/US2011/035374, filed May 5, 2011, dated Sep. 13, 2011; 7 pgs.
Hyland, Gregory E.; Office Action for Canadian application No. 2,766,850, filed May 5, 2011, dated Aug. 16, 2018, 4 pgs.
Hyland, Gregory E..; Office Action for Canadian Patent Application No. 2,766,850, filed May 5, 2011, dated Mar. 13, 2017, 4 pgs.
Hyland, Gregory E.; Mexico Office Action for serial No. MX/a/2012/000347, filed May 5, 2011, dated Dec. 13, 2016, 5 pgs.
Hyland, Gregory E.; Mexico Office Action for serial No. MX/a/2012/000347, filed May 5, 2011, dated Aug. 31, 2016, 4 pgs.
Hyland, Gregory E.; Mexico Office Action for serial No. MX/a/2012/000347, filed May 5, 2011, dated May 30, 2016, 4 pgs.
Hyland, Gregory E.; Office Action for European patent application No. 11796120.1, filed May 5, 2011, dated Feb. 9, 2018, 4 pgs.
Hyland, Gregory; Extended European Search Report for serial No. 11796120.1, filed May 5, 2011, dated Nov. 4, 2016, 8 pgs.
Hyland, Gregory E.; Australian Patent Examination Report for serial No. 2011265675, filed Jan. 21, 2012, dated Oct. 1, 2014, 3 pgs.
Hyland, Gregory E.; Japanese Office Action for serial No. 2013515338, filed Jan. 30, 2012, dated Jun. 10, 2014, 8 pgs.
Hyland, Gregory E.; Japanese Office Action for serial No. 2014-234642, filed May 5, 2011, dated Nov. 4, 2015,9 pgs.
Hyland, Gregory E.; Japanese Office Action for serial No. 2014-234642, filed May 5, 2011, dated Jul. 7, 2015, 9 pgs.
Hyland, Gregory E.; Australian Examination Report for Serial No. 2015202550, filed May 5, 2011, dated Jul. 5, 2017, 4 pgs.
Hyland, Gregory E.; Australian Examination Report for Serial No. 2015202550, filed May 5, 2011, dated May 16, 2017, 5 pgs.
Hyland, Gregory E.; Australian Examination Report for serial No. 2015202550, filed May 5, 2011, dated Feb. 9, 2017, 4 pgs.
Hyland, Gregory E.; Australian Examination Report for serial No. 2015202550, filed May 5, 2011, dated Aug. 12, 2016, 4 pgs.
Hyland, Gregory E.; Office Action for Mexico Patent Application No. MX/a/2017/006090, filed May 5, 2011, dated Sep. 26, 2018, 4 pgs.
Hyland, Gregory E.; Examination Report for Australian patent application No. 2017248541, filed Oct. 20, 2017, dated Apr. 20, 2018, 5 pgs.
Fleury, Leo W.; International Preliminary Report on Patentability for serial No. PCT/US12/50390 filed Aug. 10, 2012, dated Feb. 18, 2014, 14 pgs.
Fleury, Leo W.; International Search Report and Written Opinion for serial No. PCT/US12/50390 filed Aug. 10, 2012, dated Dec. 17, 2012, 18 pgs.
Fleury Jr., Leo W.; European Search Report for Serial No. 12823594, filed Aug. 10, 2012, dated Dec. 21, 2017, 4 pgs.
Fleury Jr., Leo W.; European Search Report for Serial No. 12823594, filed Aug. 10, 2012, dated May 10, 2017, 4 pgs.
Fleury Jr., Leo W.; European Search Report for serial No. 12823594, filed Aug. 10, 2012, dated Jun. 8, 2015, 11 pgs.
Fleury, et al.; Supplemental European Search Report for application No. 12823594.2, filed Aug. 20, 2012, dated Feb. 18, 2015, 6 pgs.
Fleury, Leo W.; Office Action for Canadian application No. 2,842,042, filed Aug. 10, 2012, dated Apr. 24, 2018, 3 pgs.
Hyland; U.S. Provisional Patent Application entitled: Infrastructure Monitoring Devices, Systems, and Methods, having U.S. Appl. No. 61/355,468, filed Jun. 16, 2010.
Fleury, Leo W., U.S. Provisional Patent Application Entitled: Hydrant Leak Detector Communication Device, System, and Method under U.S. Appl. No. 61/523,274, filed Aug. 12, 2011; 35 pgs.
Hunaidi, Osama; Issue Notification for U.S. Appl. No. 11/766,288, filed Jun. 21, 2007, dated Sep. 22, 2010, 1 pg.
Hyland, Gregory E.; Non-Final Office Action for U.S. Appl. No. 15/817,172, filed Nov. 18, 2017, dated Dec. 17, 2019, 23 pgs.
Gibson, Daryl Lee; Invitation to Pay Additional Fees for PCT/US19/45451, filed Aug. 7, 2019, dated Oct. 10, 2019, 2 pgs.
Gibson, Daryl Lee; Office Action for Canadian patent application No. 3,057,167, filed Aug. 7, 2019, dated Nov. 19, 2019, 7 pgs.
Hyland, Gregory E.; Final Office Action for U.S. Appl. No. 15/817,172, filed Nov. 18, 2017, dated Jun. 11, 2020, 33 pgs.
Fleury, Jr., Leo W.; Non-Final Office Action for U.S. Appl. No. 15/939,942, filed Mar. 29, 2018, dated May 27, 2020, 23 pgs.
Gibson, Daryl Lee; Requirement for Restriction/Election for U.S. Appl. No. 16/121,136, filed Sep. 14, 2018, dated May 7, 2020, 5 pgs.
Gibson, Daryl Lee; Office Action for Canadian patent application No. 3,057,167, filed Aug. 7, 2019, dated May 25, 2020, 3 pgs.
Gibson, Daryl Lee; Office Action for Canadian application No. 3,057,202, filed Oct. 1, 2019, dated Apr. 2, 2020, 4 pgs.
Gibson, Daryl Lee; Non-Final Office Action for U.S. Appl. No. 16/121,136, filed Sep. 4, 2018, dated Jun. 22, 2020, 94 pgs.
Keefe, Robert Paul, Office Action for Canadian application No. 3,060,512, filed May 5, 2011, dated Apr. 22, 2020, 5 pgs.
Gibson, Daryl Lee; Office Action for Canadian application No. 3,057,202, filed Oct. 1, 2019, dated Aug. 31, 2020, 4 pgs.
Hyland, Gregory E.; Supplemental Notice of Allowance for U.S. Appl. No. 15/817,172, filed Nov. 18, 2017, dated Oct. 28, 2020, 4 pgs.
Hyland, Gregory; Supplemental Notice of Allowance for U.S. Appl. No. 15/817,172, filed Nov. 18, 2017, dated Oct. 9, 2020, 4 pgs.
Hyland, Gregory E.; Notice of Allowance for U.S. Appl. No. 16/675,507, filed Nov. 6, 2019, dated Oct. 23, 2020, 16 pgs.
Hyland, Gregory E.; Supplemental Notice of Allowance for U.S. Appl. No. 16/675,507, filed Nov. 6, 2019, dated Nov. 10, 2020, 4 pgs.

(56) References Cited

OTHER PUBLICATIONS

Keefe, Robert Paul, Office Action for Canadian application No. 3,060,512, filed May 5, 2011, dated Jul. 13, 2020, 6 pgs.
Gibson, Daryl Lee; Corrected Notice of Allowance for U.S. Appl. No. 16/121,136, filed Sep. 4, 2018, dated Nov. 9, 2020, 6 pgs.
Gibson, Daryl Lee; Notice of Allowance for U.S. Appl. No. 16/121,136, filed Sep. 4, 2018, dated Sep. 29, 2020, 15 pgs.
Gibson, Daryl Lee; Office Action for Canadian patent application No. 3,057,224, filed Oct. 1, 2019, dated Nov. 10, 2020, 4 pgs.
Hunaidi, Osama; Notice of Allowance for U.S. Appl. No. 11/766,288, filed Jun. 21, 2007, dated Jun. 24, 2010, 8 pgs.
Hunaidi, Osama; Non-Final Office Action for U.S. Appl. No. 11/766,288, filed Jun. 21, 2007, dated Jan. 20, 2010, 50 pgs.
Hunaidi, Osama; Notice of Allowance for U.S. Appl. No. 09/482,317, filed Jan. 14, 2000, dated May 13, 2002, 4 pgs.
Hunaidi, Osama; Non-final Office Action for U.S. Appl. No. 09/482,317, filed Jan. 14, 2000, dated Dec. 17, 2001, 6 pgs.
Peter, Russo Anthony; European Search Report for Patent Application No. EP95307807, filed Nov. 1, 1995, dated Jul. 22, 1998, 5 pgs.
Ortiz, Jorge Isaac; Notice of Allowance for U.S. Appl. No. 15/043,057, filed Feb. 12, 2016, dated Feb. 19, 2019, 8 pgs.
Ortiz, Jorge Isaac; Final Office Action for U.S. Appl. No. 15/043,057, filed Feb. 12, 2016, dated Dec. 12, 2018, 25 pgs.
Ortiz, Jorge Isaac; Non-Final Office Action for U.S. Appl. No. 15/043,057, filed Feb. 12, 2016, dated Jun. 4, 2018, 94 pgs.
Ortiz, Jorge Isaac; International Preliminary Report on Patentability for PCT Application No. PCT/US2016/067689, filed Dec. 20, 2016, dated Aug. 23, 2018, 8 pgs.
Ortiz, Jorge; International Search Report and Written Opinion for PCT/US16/67689, filed Dec. 20, 2016, dated Mar. 8, 2017, 9 pgs.
Gibson, Daryl Lee; Notice of Allowance for U.S. Appl. No. 15/255,795, filed Sep. 2, 2016, dated Jan. 17, 2019, 17 pgs.
Gibson, Daryl Lee; Final Office Action for U.S. Appl. No. 15/255,795, filed Sep. 2, 2016, dated Aug. 31, 2018, 33 pgs.
Hyland, Gregory E.; Notice of Allowance for U.S. Appl. No. 15/817,172, filed Nov. 18, 2017, dated Aug. 21, 2020, 9 pgs.
Hyland, Gregory E.; Final Office Action for U.S. Appl. No. 16/675,507, filed Nov. 6, 2019, dated Jun. 26, 2020, 70 pgs.
Dintakurti, Ganapathi Deva Varma; Corrected Notice of Allowance for U.S. Appl. No. 13/492,794, filed Jun. 8, 2012, dated Dec. 6, 2018, 6 pgs.
Ortiz, Jorge Isaac; Supplemental Notice of Allowance for U.S. Appl. No. 15/043,057, filed Feb. 12, 2016, dated Mar. 13, 2019, 6 pgs.
Dintakurti, Ganapathi Deva Varma; Notice of Allowance for U.S. Appl. No. 13/492,794, filed Jun. 8, 2012, dated Sep. 24, 2018, 21 pgs.
Fleury, Jr., Leo W.; Notice of Allowance for U.S. Appl. No. 15/401,457, filed Jan. 9, 2017, dated Apr. 16, 2019, 88 pgs.
Ortiz, Jorge Isaac; Issue Notification for U.S. Appl. No. 15/043,057, filed Feb. 12, 2016, dated Apr. 17, 2019, 1 pg.
Gibson, Daryl Lee; Corrected Notice of Allowance for U.S. Appl. No. 15/255,795, filed Sep. 2, 2016, dated Mar. 21, 2019, 6 pgs.
Dintakurti, Ganapathi Deva Varma; Issue Notification for U.S. Appl. No. 13/492,794, filed Jun. 8, 2012, dated Dec. 19, 2018, 1 pg.
Fleury, Leo W.; Office Action for Canadian application No. 2,842,042, filed Aug. 10, 2012, dated Feb. 28, 2019, 3 pgs.
Fleury, Jr., Leo W.; Final Office Action for U.S. Appl. No. 15/939,942, filed Mar. 29, 2018, dated Feb. 19, 2020, 29 pgs.
Ortiz, Jorge Isaac; Office Action for Canadian patent application No. 3,070,690, filed Dec. 20, 2016, dated Mar. 10, 2020, 3 pgs.
Gibson, Daryl Lee; Extended European Search Report for 16890115.5, filed Dec. 20, 2016, dated Jan. 24, 2020, 10 pgs.
Fleury, Jr., Leo W.; Non-Final Office Action for U.S. Appl. No. 15/939,942, filed Mar. 29, 2018, dated Sep. 25, 2019, 92 pgs.
Hyland, Gregory E.; Office Action for Canadian patent application No. 2,766,850, filed May 5, 2011, dated Jun. 19, 2019, 4 pgs.
Ortiz, Jorge Isaac; Extended European Search Report for serial No. 16890114.8, filed Dec. 20, 2016, dated Sep. 26, 2019, 11 pgs.
Hyland, Gregory E.; Supplemental Notice of Allowance for U.S. Appl. No. 15/817,172, filed Nov. 18, 2017, dated Dec. 7, 2020, 4 pgs.
Fleury, Jr., Leo W.; Final Office Action for U.S. Appl. No. 15/939,942, filed Mar. 29, 2018, dated Nov. 25, 2020, 37 pgs.
Gibson, Daryl Lee; Non-Final Office Action for U.S. Appl. No. 16/352,045, filed Mar. 13, 2019, dated Nov. 25, 2020, 106 pgs.
Gibson, Daryl Lee; Office Action for Canadian patent application No. 3,010,345, filed Dec. 20, 2016, dated Oct. 6, 2020, 4 pgs.
Fleury, Jr., Leo W.; Non-Final Office Action for U.S. Appl. No. 15/939,942, filed Mar. 29, 2018, dated Mar. 24, 2021, 32 pgs.
Fleuryjr., Leo W.; Final Office Action for U.S. Appl. No. 15/939,942, filed Mar. 29, 2018, dated Aug. 27, 2021, 30 pgs.
Ortiz, Jorge Isaac; Non-Final Office Action for U.S. Appl. No. 16/354,939, filed Mar. 15, 2019, dated Aug. 10, 2021, 126 pgs.
Gibson, Daryl Lee; Non-Final Office Action for U.S. Appl. No. 16/352,045, filed Mar. 13, 2019, dated Aug. 13, 2021, 20 pgs.
Gibson, Daryl Lee; Non-Final Office Action for U.S. Appl. No. 17/079,642, filed Oct. 26, 2020, dated Aug. 30, 2021, 84 pgs.
ABT, Inc., Installation Instructions Belleville Washer springs (Year: 2014), 1 pg.
Gibson, Daryl Lee; Non-Final Office Action for U.S. Appl. No. 16/428,744, filed May 31, 2019, dated Aug. 2, 2021, 121 pgs.
QRFS, Storz FDCs and fire Hydrant Storz connections: Adapters or integral Storz, Mar. 2019 (Year: 2019), 21 pgs.
Speacialinsert, Inserts for plastic (Year: 2016), 36 pgs.
Gibson, Daryl Lee; Non-Final Office Action for U.S. Appl. No. 17/245,419, filed Apr. 30, 2021, dated Sep. 2, 2021, 82 pgs.
Gibson, Daryl; Office Action for U.S. Appl. No. 3,057,224, filed Oct. 1, 2019, dated Jun. 23, 2021, 4 pgs.
Ortiz, Jorge Isaac; Non-Final Office Action for U.S. Appl. No. 17/245,181, filed Apr. 30, 2021, dated Sep. 16, 2021, 82 pgs.
Ortiz, Jorge Isaac; Office Action for European patent application No. 16890114.8, filed Dec. 20, 2016, dated Oct. 4, 2021, 7 pgs.
Gibson, Daryl Lee; Extended European Search Report for application No. 21180958.7, filed Aug. 7, 2019, dated Oct. 5, 2021, 8 pgs.
Gibson, Daryl Lee; International Search Report and Written Opinion for PCT Application No. PCT/US21/31033, filed May 6, 2021, dated Sep. 24, 2021, 12 pgs.
Ortiz, Jorge Isaac; Requirement for Restriction/Election for U.S. Appl. No. 17/245,181, filed Apr. 30, 2021, dated Jul. 22, 2021, 6 pgs.
Gibson, Daryl Lee; Final Office Action for U.S. Appl. No. 16/352,045, filed Mar. 13, 2019, dated May 4, 2021, 33 pgs.
Gibson, Daryl Lee; Invitation to Pay Additional Fees for PCT/US21/31033, filed May 6, 2021, dated Jul. 15, 2021, 2 pgs.
Fleury Jr., Leo W., Advisory Action for U.S. Appl. No. 15/939,942, filed Mar. 29, 2018, dated Dec. 7, 2021, 2 pgs.
Ortiz, Jorge Isaac; Final Office Action for U.S. Appl. No. 17/245,181, filed Apr. 30, 2021, dated Dec. 7, 2021, 28 pgs.
Ortiz, Jorge Isaac; Office Action for Canadian patent application No. 3,095,465, filed Dec. 20, 2016, dated Nov. 8, 2021, 4 pgs.
Gibson, Daryl Lee; Notice of Allowance for U.S. Appl. No. 16/352,045, filed Mar. 13, 2019, dated Dec. 1, 2021, 24 pgs.
Gibson, Daryl Lee; Applicant-Initiated Interview Summary for U.S. Appl. No. 17/245,419, filed Apr. 30, 2021, dated Dec. 2, 2021, 2 pgs.
Gibson, Daryl Lee; Final Office Action for U.S. Appl. No. 17/245,419, filed Apr. 30, 2021, dated Oct. 25, 2021, 27 pgs.
Gibson, Daryl Lee; Final Office Action for U.S. Appl. No. 17/079,642, filed Oct. 26, 2020, dated Dec. 14, 2021, 17 pgs.
Gibson, Daryl Lee; Applicant-Initiated Interview Summary for U.S. Appl. No. 17/079,642, filed Oct. 26, 2020, dated Feb. 9, 2022, 2 pgs.
Gibson, Daryl Lee; Non-Final Office Action for U.S. Appl. No. 17/245,419, filed Apr. 30, 2021, dated Jan. 14, 2022, 27 pgs.

* cited by examiner

NOZZLE CAP ENCAPSULATED ANTENNA SYSTEM

TECHNICAL FIELD

This disclosure relates to nozzle caps. More specifically, this disclosure relates to a nozzle cap of a fire hydrant which is configured to wirelessly transmit a signal.

BACKGROUND

Some fluid systems, such as water distribution systems, can comprise fire hydrants which can be attached to legs of the fluid system, such as a water main. Fire hydrants typically have one or more nozzles sealed with a nozzle cap. In an Advanced Metering Infrastructure, the fire hydrants can be configured to wirelessly transmit data. For example, the nozzle cap of a fire hydrant can contain a vibration sensor configured to detect leaks within the fluid system, and information about the presence or absence of leaks can be wirelessly transmitted to an agency tasked with managing and maintaining the water distribution system. However, nozzle caps configured to wirelessly transmit information can contain delicate electronics which can easily be damaged by impacts, as nozzle caps commonly experience. Additionally, the fire hydrants and nozzle caps are commonly made of metal which can interfere with wireless transmission of a signal from within a nozzle cap.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a nozzle cap comprising a cap body defining a first body end and a second body end, the cap body defining a circumferential wall extending from the first body end towards the second body end; an antenna cover circumferentially overlapping a portion of the circumferential wall, the antenna cover defining an inner cover surface facing the circumferential wall, an antenna cavity defined between the inner cover surface and the portion of the circumferential wall; and an antenna printed circuit board ("PCB") strip positioned within the antenna cavity, the antenna PCB strip secured in facing engagement with the inner cover surface.

Also disclosed a method for installing an antenna printed circuit board ("PCB") strip in a nozzle cap, the method comprising attaching the antenna PCB strip to an inner cover surface of an antenna cover; circumferentially covering a portion of a circumferential wall of the nozzle cap with an antenna cover, an antenna cavity defined between the portion of the circumferential wall and the inner cover surface of the antenna cover; and filling the antenna cavity with potting.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
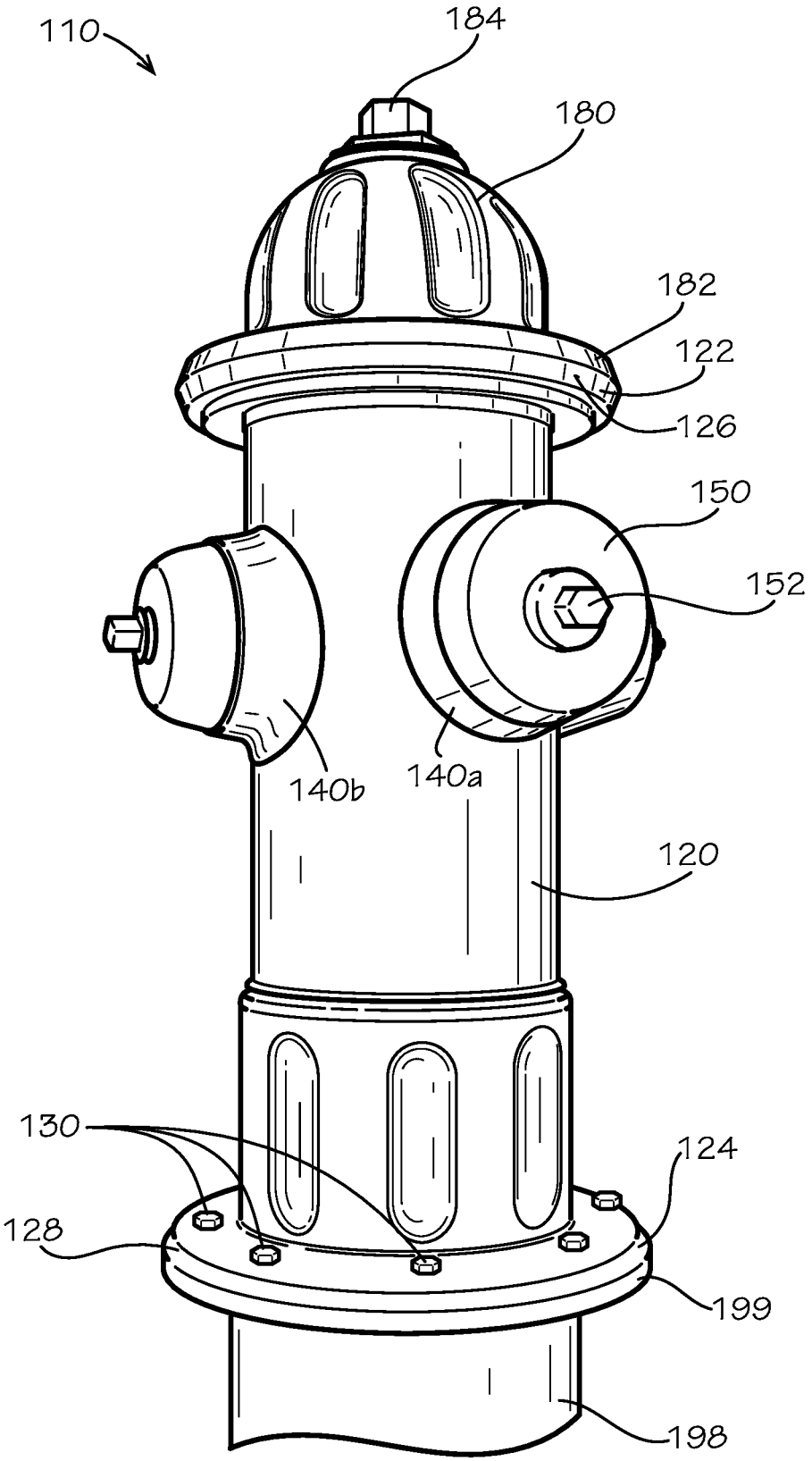
FIG. 1 is a perspective view of a fire hydrant comprising a barrel, a nozzle cap, and a bonnet in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a nozzle cap and associated methods, systems, devices, and various apparatus. The nozzle cap can comprise a cap body, a pair of antenna printed circuit boards ("PCBs") strips, and a pair of antenna covers. It would be understood by one of skill in the art that the disclosed nozzle cap is described in but a few exemplary aspects among many. No particular terminology or description should be considered limiting on the disclosure or the scope of any claims issuing therefrom.

FIG. 1 is a perspective view of a fire hydrant 110 comprising a barrel 120, a nozzle cap 150, and a bonnet 180. The barrel 120 can define a top barrel end 122 and a bottom barrel end 124 disposed opposite from the top barrel end 122. The barrel 120 can be substantially tubular. The barrel 120 can comprise a top flange 126 disposed at the top barrel end 122 and a base flange 128 disposed at the bottom barrel end 124. The base flange 128 can be fastened to a stand pipe flange 199 of a stand pipe 198 of a fluid system (not shown), such as a water main for example and without limitation. The base flange 128 can be fastened to the stand pipe flange 199 by a plurality of fasteners 130. A bonnet flange 182 of the bonnet 180 can be attached to the top flange 126 of the barrel 120, such as with a plurality of fasteners (not shown) similar to the fasteners 130. The bonnet 180 can comprise an operation nut 184, or "op nut", which can be rotated to open and close a main valve (not shown) positioned at the bottom barrel end 124 or below in the stand pipe 198 in order to respectively supply or cut off pressurized water supply to the fire hydrant 110.

The barrel 120 can define one or more nozzles 140*a,b*. The nozzle cap 150 can be screwed onto the nozzle 140*a* to seal the nozzle 140*a*. With the nozzle cap 150 sealing the nozzle 140*a*, pressurized water cannot escape through the nozzle 140*a* when the main valve (not shown) is in an open position. The nozzle cap 150 can define a cap nut 152 which can be turned, such as with a wrench, to tighten or loosen the nozzle cap 150 on the nozzle 140*a*.

Figure 2:
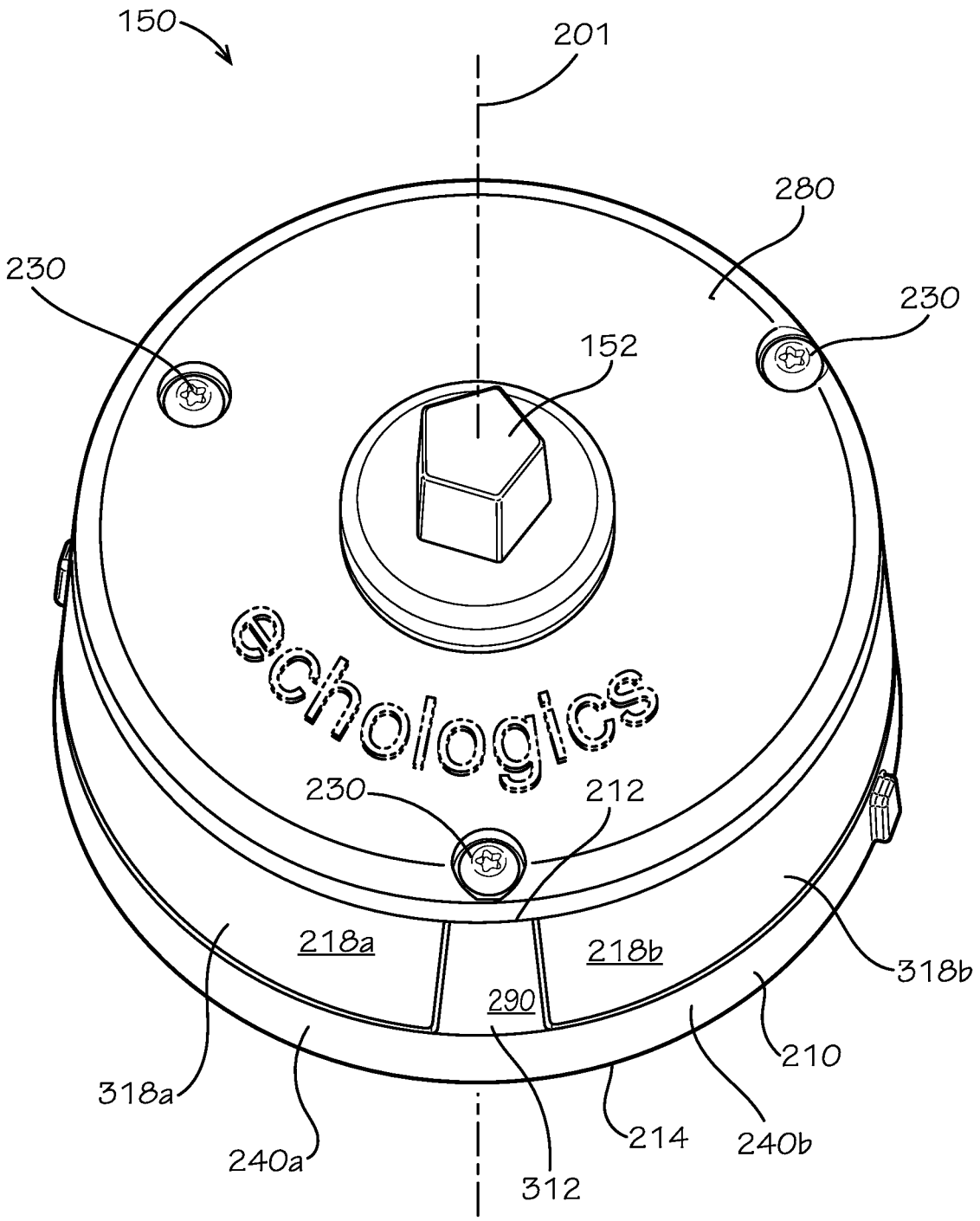
FIG. 2 is a front perspective view of the nozzle cap of FIG. 1 comprising a cap body and a cap cover attached to the cap body by fasteners.

FIG. 2 is a perspective front view of the nozzle cap 150 of the fire hydrant 110 of FIG. 1. The nozzle cap 150 can comprise a cap body 210, a cap cover 280, and a pair of antenna covers 318*a,b*. The cap body 210 can define a first body end 212 and a second body end 214, and the first body end 212 can be disposed opposite from the second body end 214. The cap body 210 can define a cap axis 201 extending from the first body end 212 to the second body end 214. The cap axis 201 can extend through the cap nut 152 such that rotating the nozzle cap 150 by turning the cap nut 152, such as with a wrench, can rotate the nozzle cap 150 about the cap axis 201.

The cap body 210 can define a pair of bottom shelves 240*a,b* at the second body end 214. Each bottom shelf 240*a,b* can respectively be positioned beneath a different one of the antenna covers 318*a,b* with respect to the present viewing angle. The cap cover 280 can be secured to the first body end 212 by a plurality of fasteners 230. The bottom shelves 240*a,b* and the cap cover 280 can radially overlap with each of the antenna covers 318*a,b*, respectively, to axially secure each antenna cover 318*a,b* between the respective bottom shelf 240*a,b* and the cap cover 280 relative to the cap axis 201.

The cap body 210 can also define a circumferential wall 312 extending from the first body end 212 towards the second body end 214, and each antenna cover 318*a,b* can circumferentially overlap a different portion of the circumferential wall 312. In the present aspect, each antenna cover 318*a,b* can respectively define an outer cover surface 218*a,b*, and the circumferential wall 312 can define an outer wall surface 290. In the present aspect, each of the outer cover surfaces 218*a,b* can be positioned flush with the outer wall surface 290.

Figure 3:
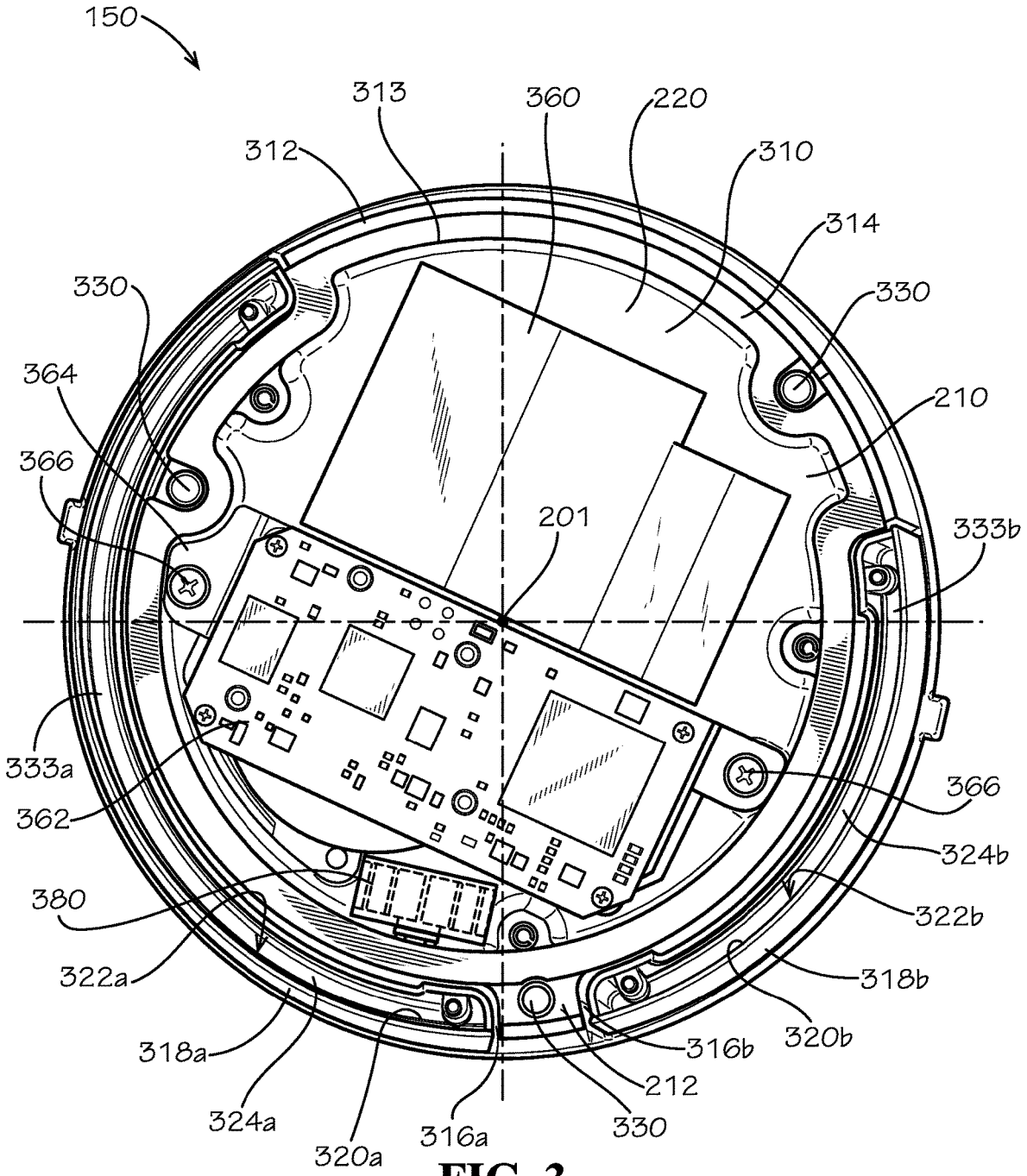
FIG. 3 is a front view of the nozzle cap of FIG. 1 facing a first body end of the cap body with the cap cover and the fasteners removed.

FIG. 3 is a front view of the nozzle cap 150 of FIG. 1 facing the first body end 212 with the cap cover 280 (shown in FIG. 2) and fasteners 230 (shown in FIG. 2) removed to expose a cavity 310 within the cap body 210. The cap body 210 can define fastener holes 330 configured to receive the fasteners 230 to secure the cap cover 280 to the cap body 210. The cavity 310 can extend inwards into the cap body 210 from the first body end 212 to an inner wall 220 of the cap body 210. As shown, the circumferential wall 312 can extend around a circumference of the cap body 210, and the circumferential wall 312 can partially enclose the cavity 310. A cavity opening 313 to the cavity 310 can be defined at the first body end 212, and a cavity gasket 314 can extend around the cavity opening 313. The cavity gasket 314 can be configured to seal with the cap cover 280 (shown in FIG. 2) to enclose the cavity 310.

As previously discussed, the antenna covers 318*a,b* can circumferentially overlap portions of the circumferential wall 312. In the present aspect, the portions can be scalloped portions defined by external scallops 316*a,b*, respectively. The external scallops 316*a,b* can extend axially inward into the outer wall surface 290 of the circumferential wall 312 relative to the cap axis 201, shown extending out of the page. As shown, the antenna covers 318*a,b* can fit within the external scallops 316*a,b*, respectively.

The nozzle cap 150 can further comprise a pair of antenna printed circuit boards ("PCBs") 320*a,b* which can be respectively enclosed within each of the external scallops 316*a,b* between the respective antenna cover 318*a,b* and the circumferential wall 312. Each antenna cover 318*a,b* can define an inner cover surface 322*a,b*, respectively, which can face the circumferential wall 312. An antenna cavity 324*a,b* can respectively be defined between each of the inner cover surfaces 322*a,b* and the scalloped portions of the circumferential wall 312 defined by the external scallops 316*a,b*. The antenna covers 318*a,b* can each partially enclose the respective antenna cavity 324*a,b*. In the present aspect, the antenna PCB strips 320*a,b* can be secured in facing engagement with the inner cover surface 322*a,b*.

The nozzle cap 150 can further comprise a pair of spacer strips 326*a,b* (shown in FIG. 4) disposed within the respective antenna cavity 324*a,b*. The spacer strips 326*a,b* can be positioned between the respective antenna cover 318*a,b* and the circumferential wall 312, and the spacer strips 326*a,b* can be in facing engagement with the adjacent antenna cover 318*a,b* and the circumferential wall 312. In the present aspect, the spacer strips 326*a,b* can comprise an adhesive which can be bonded to either or both of the respective antenna cover 318*a,b* and the circumferential wall 312. In the present aspect, the spacer strips 326*a,b* can comprise a compressible material, such as foam, rubber, an elastomer, or any other suitable material. The spacer strips 326*a,b* can be compressed by the respective antenna covers 318*a,b*, thereby forming a seal between the antenna covers 318*a,b* and the circumferential wall 312.

The antenna PCB strips 320*a,b* can be attached to the inner cover surface 322*a,b* of the respective antenna cover 318*a,b*, such as with an adhesive, a tape, or a mechanical fastener, such as hook-and-loop strips, a screw, a bolt, a snap, or any other suitable attachment mechanism. In some aspects, the antenna PCB strips 320*a,b* can be positioned atop a bottom cover surface 333*a,b* of the respective antenna covers 318*a,b*. The bottom cover surfaces 333*a,b* can be defined within the respective antenna cavities 324*a,b*.

The spacer strips 326*a,b* can primarily act as a temporary sealing mechanism for filling the antenna cavities 324*a,b* with a potting material. With any gaps between the antenna covers 318*a,b* and the circumferential wall 312 sealed by the spacer strips 326*a,b*, potting can be poured into each antenna cavity 324*a,b* in a liquid or amorphous form, and the potting can be allowed to cure. The potting can permanently seal the respective antenna cavity 324*a,b*, and the potting can permanently secure each antenna PCB strip 320*a,b* in facing engagement with the inner cover surface 322*a,b*. The potting can secure the antenna PCB strips 320*a,b* permanently in position in a manner which resists vibration and impact.

The potting can at least partially be positioned between the antenna PCB strips 320*a,b* and the circumferential wall 312. In some aspects, the circumferential wall 312 can interfere with transmissions from the antenna PCB strips 320*a,b*. The potting can maintain a constant gap between the circumferential wall 312 and the respective antenna PCB strips 320*a,b*, therefore providing consistent transmission tuning of the antenna PCB strip 320*a,b*. The potting can also seal out moisture, debris, and other foreign matter which could enter the antenna cavities 324*a,b* and interfere with the operation of the antenna PCB strips 320*a,b*. By attaching the antenna PCB strips 320*a,b* to the respective inner cover surfaces 322*a,b*, the gap between the circumferential wall 312 and the antenna PCB strips 320*a,b* can be maximized to reduce potential interference.

The nozzle cap 150 can comprise a battery pack 360, a processing printed circuit board ("PCB") 362, and a vibration sensor 380 disposed within the cavity 310. The processing PCB 362 can be attached to a mounting bracket 364 which can be secured within the cavity 310 by a pair of fasteners 366. The vibration sensor 380 can be attached to the circumferential wall 312 within the cavity 310, and the vibration sensor 380 can extend radially inward towards the cap axis 201 (shown extending out of the page).

The battery pack 360, the processing PCB 362, the vibration sensor 380, and the antenna PCB strips 320*a,b* can all be connected in electrical communication. The vibration sensor 380 can be configured to detect leaks within the fluid system (not shown) by monitoring vibrations travelling up the stand pipe 198 (shown in FIG. 1) and through the fire hydrant 110 (shown in FIG. 1) when the nozzle cap 150 is mounted on the nozzle 140*a* (shown in FIG. 1). Vibration patterns within the fluid system can indicate the presence of leaks within the fluid system. The vibration sensor 380 can produce voltage readings when the vibration sensor 380 experiences vibrations. These voltage readings can be processed by the processing PCB 362 to determine whether leaks are present, and a signal can be transmitted outwards from the nozzle cap 150 with the antenna PCB strips 320*a,b* to convey whether leaks have been identified within the fluid system.

Figure 4:
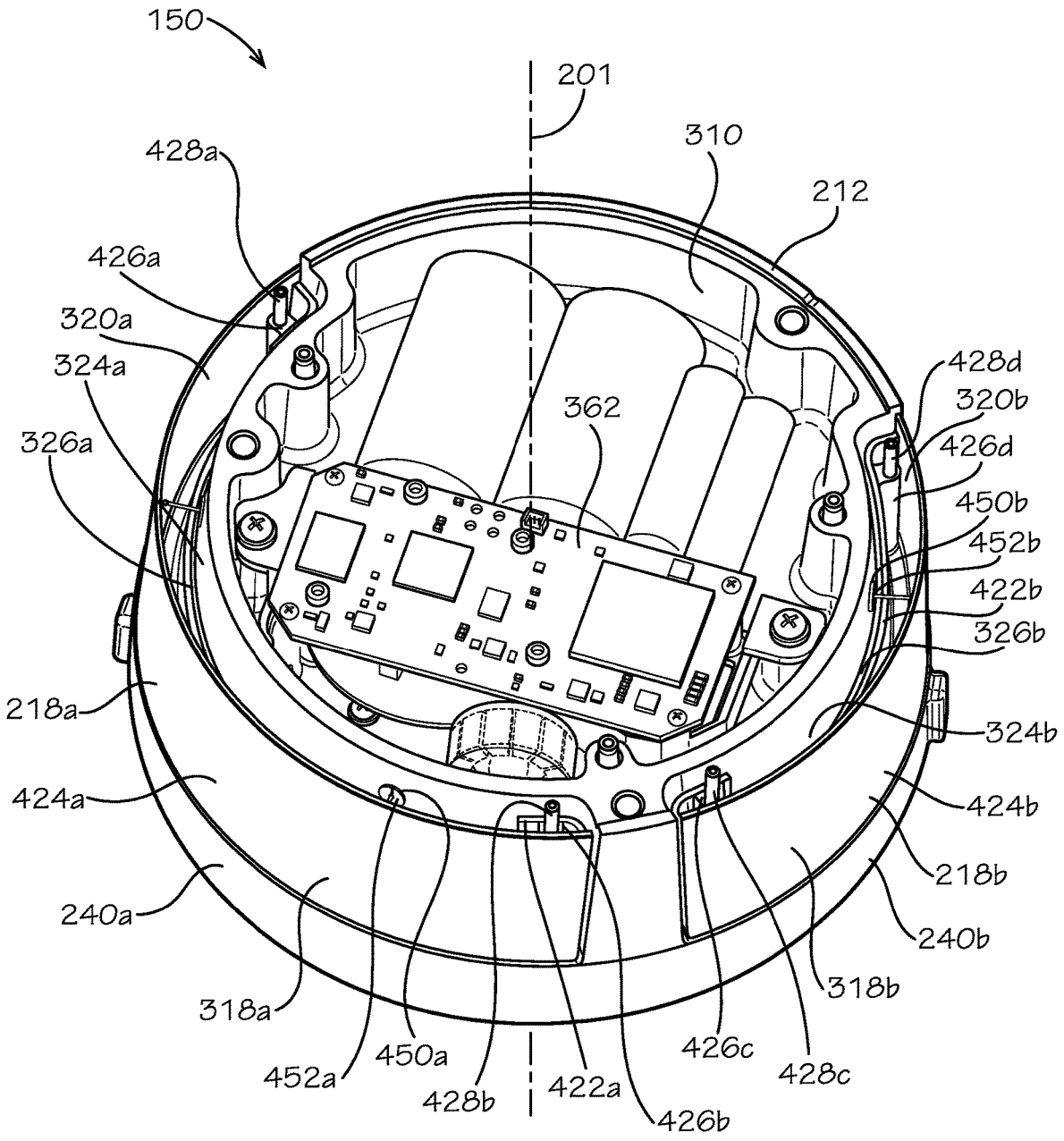
FIG. 4 is a front perspective view of the nozzle cap of FIG. 1, with a cavity gasket of the nozzle cap additionally removed.
Figure 5:
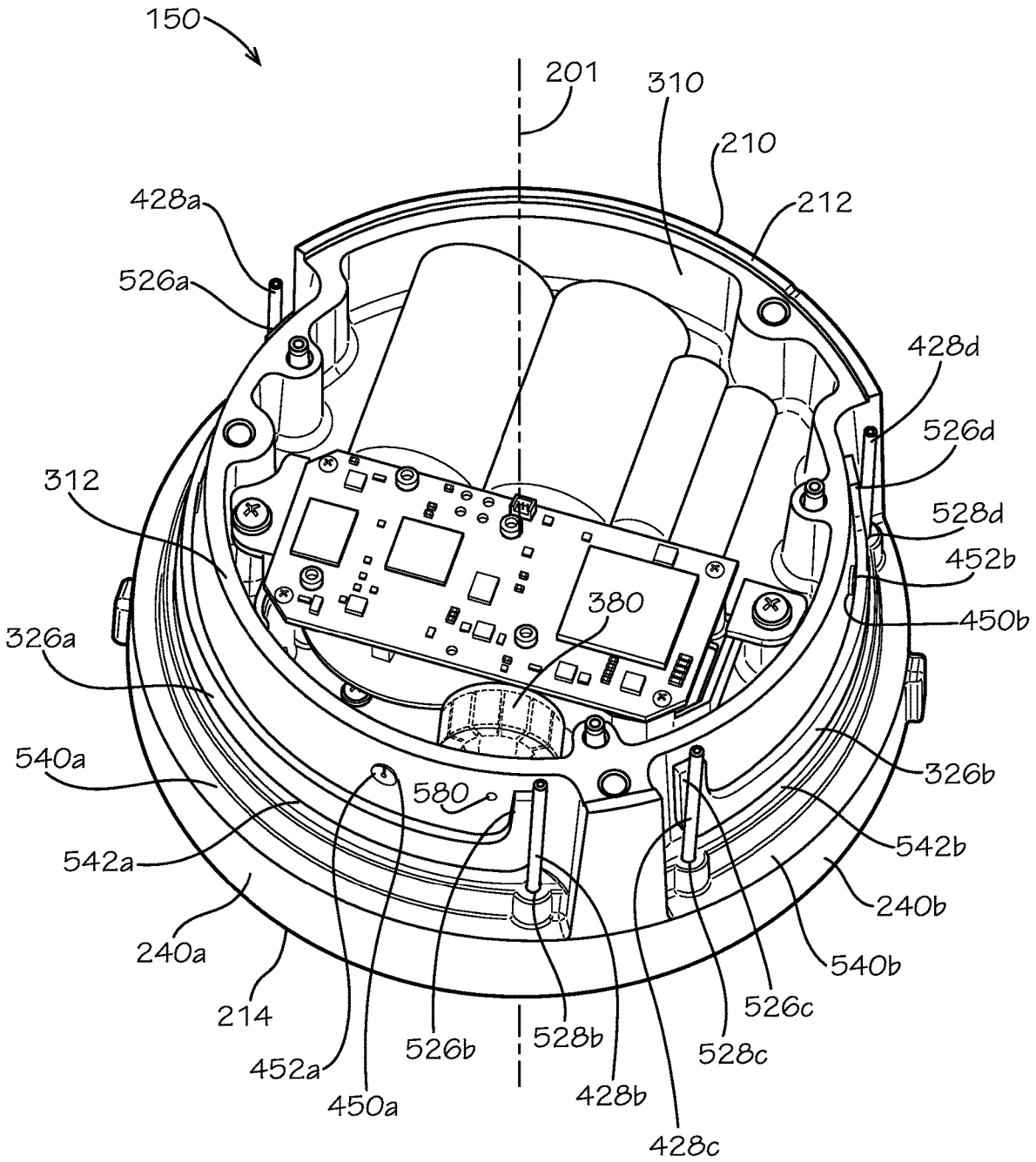
FIG. 5 is a front perspective view of the nozzle cap of FIG. 1, with the antenna covers and the antenna printed circuit board ("PCB") strips of the nozzle cap additionally removed.

FIG. 4 is a front perspective view of the nozzle cap 150 of FIG. 1 with the cap cover 280 (shown in FIG. 2), and the cavity gasket 314 (shown in FIG. 3) removed. As shown, each of the antenna covers 318*a,b* can comprise an inner layer 422*a,b*, respectively, and an outer layer 424*a,b*, respectively. The inner layers 422*a,b* can define a wide U-shape which can be shaped complimentary to the spacer strips 326*a,b* as illustrated in FIG. 5. The outer layers 424*a,b* can respectively define the inner cover surfaces 322*a,b* (as shown below in FIG. 8), and the outer layers 424*a,b* can define the outer cover surfaces 218*a,b*, respectively. The inner cover surfaces 322*a,b* can be defined opposite from the outer cover surfaces 218*a,b*. Each antenna cover 318*a,b* can comprise a pair of pin guides 426*a-d*, and the pin guides 426*a-d* can be positioned between the adjacent inner layers 422*a,b* and outer layers 424*a,b*, respectively. The antenna PCB strips 320*a,b* can extend between the respective pin guides 426*a-d* and outer layers 424*a,b*.

A pin 428*a-d* can extend through each of the pin guides 426*a-d*, and the pins 428*a-d* can be attached to the respective bottom shelves 240*a,b*. The antenna covers 318*a,b* can slide axially with respect to the cap axis 201 along the pins 428*a-d* to install or remove the antenna covers 318*a,b* from the cap body 210. When the cap cover 280 (shown in FIG. 2) is attached to the first body end 212, the antenna covers 318*a,b* can be axially secured between the cap cover 280 and the bottom shelves 240*a,b*, thereby preventing removal of the antenna covers 318*a,b* from the cap body 210. Additionally, the cap cover 280 can fully enclose the antenna cavities 324*a,b* proximate to the first body end 212.

The antenna PCB strips 320*a,b* can be connected to the processing PCB 362 by wires passing through wire ports 450*a-c* (wire port 450*c* shown in FIG. 8) can be exposed. In the present aspect, the wires can be coaxial cable feedlines. The wire ports 450*a-c* can extend through the circumferential wall 312 from the respective antenna cavity 324*a,b* to the cavity 310. Each of the wire ports 450*a-c* can be sealed with a plug 452*a-c* (plug 452*c* shown in FIG. 8), respectively. The plugs 452*a-c* can be split plugs configured to accommodate a wire (not shown) of the respective antenna PCB strip 320*a,b*. The wires of the antenna PCB strips 320*a,b* can extend through the plugs 452*a-c* and through the wire ports 450*a-c* into the cavity 310 to connect the antenna PCB strips 320*a,b* to the processing PCB 362. The plugs 452*a-c* can seal the wire ports 450*a-c* around the wires. In the present aspect, the plugs 452*a-c* can primarily serve as a temporary sealing mechanism for when the potting is poured into the antenna cavities 324*a,b*, respectively. Once the potting has cured within the antenna cavities 324*a,b*, each antenna cavity 324*a,b* can be fully sealed against the elements, dirt, water, or any other foreign matter.

FIG. 5 is a front perspective view of the nozzle cap 150 with the cap cover 280 (shown in FIG. 2), the cavity gasket 314 (shown in FIG. 3), the antenna PCB strips 320*a,b* (shown in FIG. 3), the coaxial cable feedlines, and the antenna covers 318*a,b* (shown in FIG. 3) removed. With the antenna PCB strips 320*a,b* and the antenna covers 318*a,b* removed, the wire ports 450*a,b* and plugs 452,*a,b* can be exposed. As shown, each of the bottom shelves 240*a,b* can each respectively define a lower shelf surface 540*a,b* and an upper shelf surface 542*a,b* positioned above the lower shelf surface 540*a,b*. In the present aspect, each spacer strip 326*a,b* can rest upon the respective upper shelf surface 542*a,b*. As described above, the spacer strips 326*a,b* can define a wide U-shape wherein opposing ends 526*a-d* of each respective spacer strip 326*a,b* extend upwards towards the first body end 212.

Figure 6:
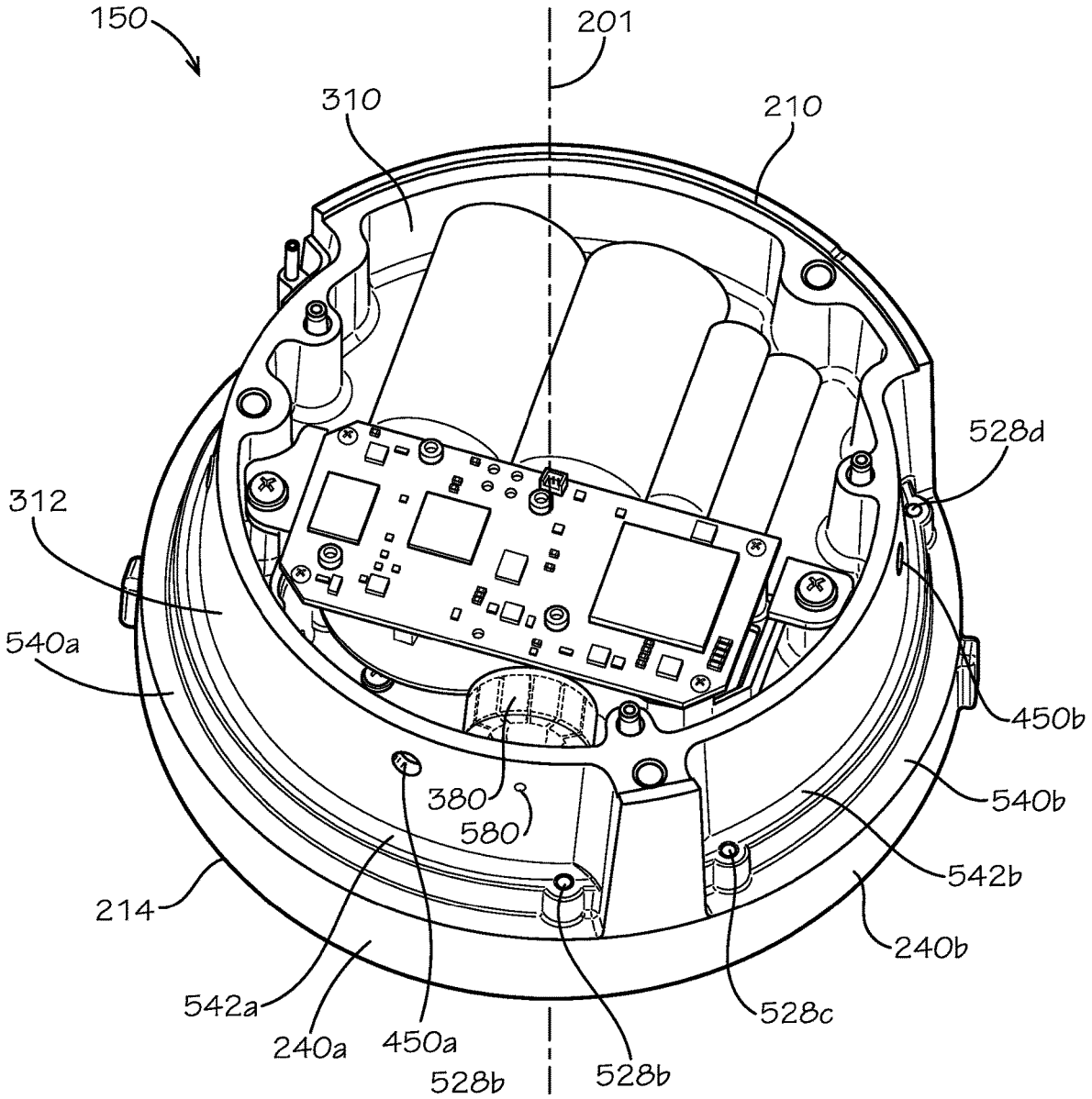
FIG. 6 is a front perspective view of the nozzle cap of FIG. 1, with the spacer strips, the plugs, and the pins of the nozzle cap additionally removed.

The cap body 210 can define pin holes 528*b-d* corresponding to pins 428*b-d*. A pin hole corresponding to pin 428*a* can also be defined but is not shown in the present view; however, pin holes 528*b-d* can be representative of the pin hole of pin 528*a*. The pin holes 528*b-d* can extend axially downward into the upper shelf surface 542*a,b* and towards the second body end 214 relative to the cap axis 201, as shown in FIGS. 5 and 6. The pins 428*b-d* can be received within the pin holes 528*b-d*, and the pins 428*b-d* can be aligned substantially parallel to the cap axis 201.

The cap body 210 can also define a threaded bore 580 which can extend through the circumferential wall 312 substantially perpendicular to the cap axis 201. A threaded end 780 (shown in FIG. 7) of the vibration sensor 380 can threadedly engage the threaded bore 580 to attach the vibration sensor 380 to the circumferential wall 312 within the cavity 310.

Figure 7:
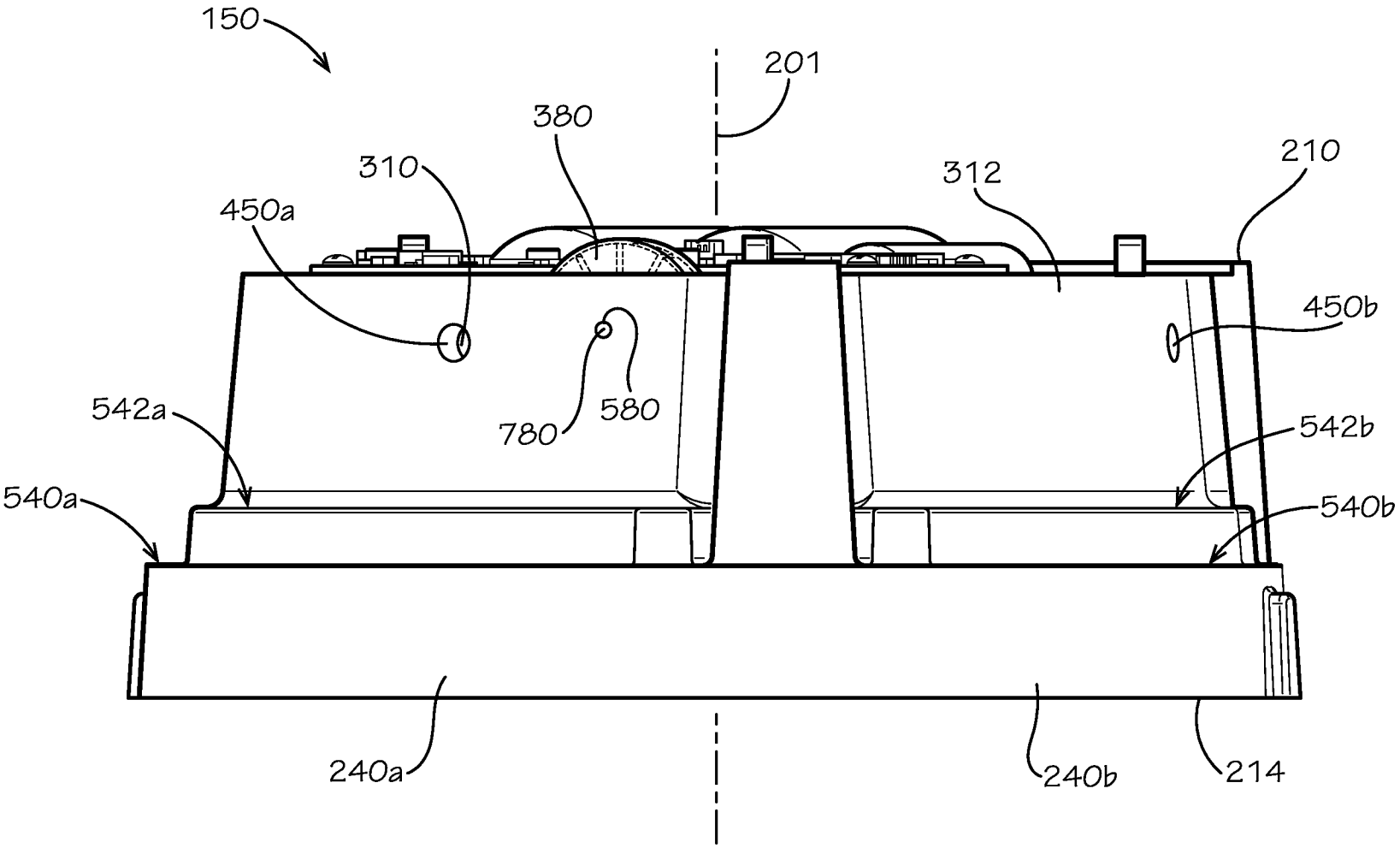
FIG. 7 is a side view of the nozzle cap of FIG. 1, as configured in FIG. 6.

FIG. 6 is a front perspective view of the nozzle cap 150 of FIG. 1, and FIG. 7 is a side view of the nozzle cap 150 of FIG. 1, each shown with the cap cover 280 (shown in FIG. 2), the cavity gasket 314 (shown in FIG. 3), the antenna PCB strips 320*a,b* (shown in FIG. 3), the spacer strips 326*a,b* (shown in FIG. 3), the plugs 452*a-c* (plugs 452*a,b* shown in FIG. 4, plug 452*c* shown in FIG. 8), the pins 428*a-d*, and the antenna covers 318*a,b* (shown in FIG. 3) removed. With the pins 428*a-d* removed, the pin holes 528*b-d* are shown exposed in FIG. 6. As previously described, the pin holes 528*b-d* can extend axially downwards, relative to the cap axis 201, into the respective bottom shelves 240*a,b* of the cap body 210 from the upper shelf surfaces 542*a,b* towards the second body end 214. In other aspects, the pin holes 528*b-d* can extend axially downwards into the respective bottom shelves 240*a,b* of the cap body 210 from the lower shelf surfaces 540*a,b* towards the second body end 214. In other aspects, the pin holes 528*b-d* can be threaded, and the pins 428*a-d* can be replaced by fasteners, such as screws or bolts, which can secure the antenna covers 318*a,b* to the cap body 210. With the plugs 452*a-c* removed, the wire ports 450*a-c* (wire port 450*c* and plug 452*c* shown in FIG. 8) can be open and unobstructed. As demonstrated by wire port 450*a* in FIG. 7, each of the wire ports 450*a-c* can extend through the circumferential wall 312 to the cavity 310. As further shown in FIG. 7, the threaded bore 580 can extend through the circumferential wall 312, and the threaded bore 580 can receive the threaded end 780 of the vibration sensor 380 to secure the vibration sensor 380 to the circumferential wall 312.

Figure 8:
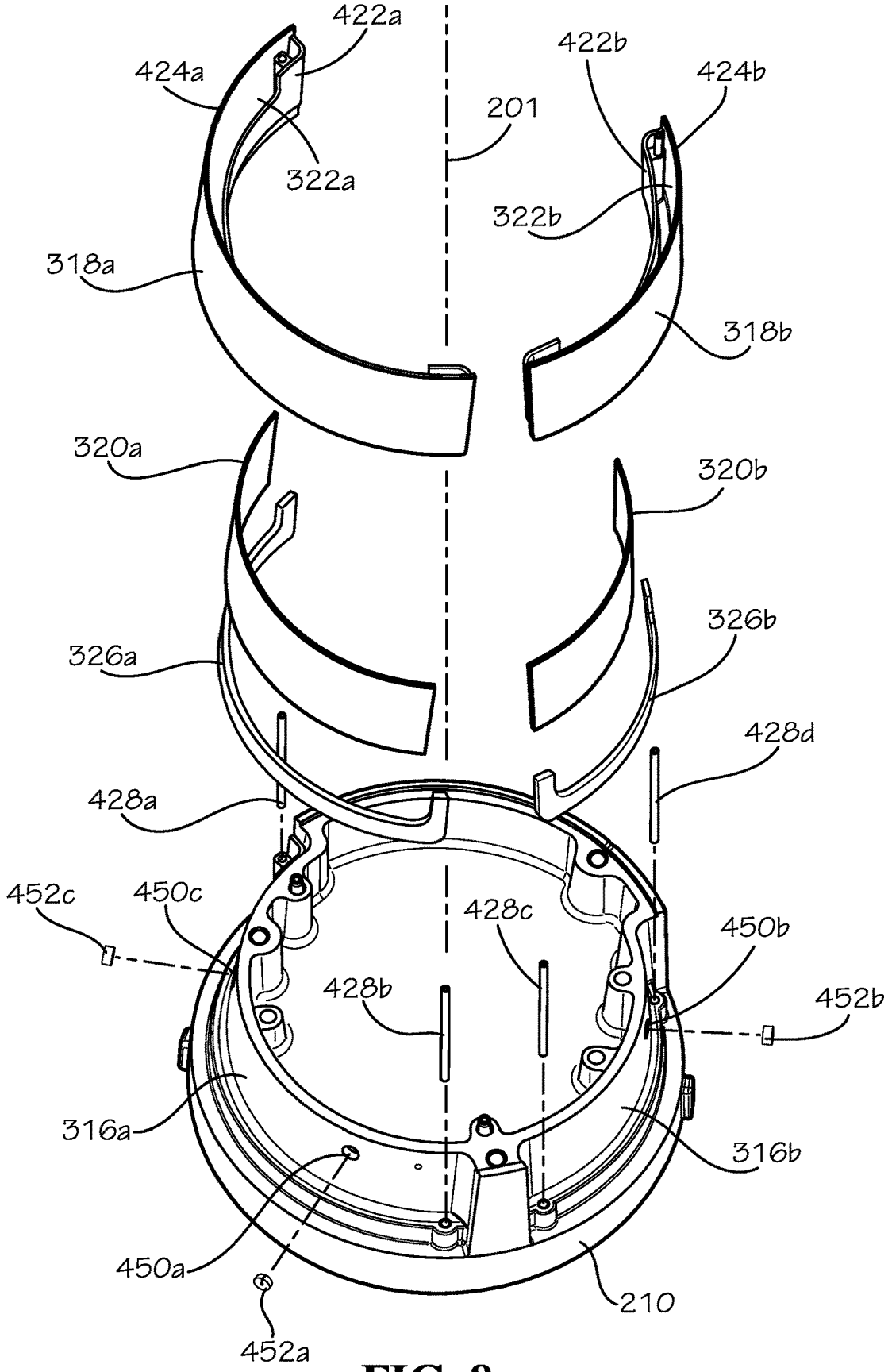
FIG. 8 is a front exploded view of the cap body, the plugs, the pins, the spacer strips, the antenna PCB strips, and the antenna covers of the nozzle cap of FIG. 1.
Figure 9:
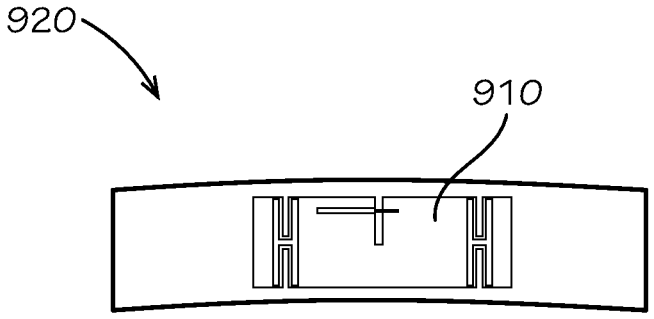
FIG. 9 is a front view of an antenna PCB strip comprising a Global System for Mobile communications ("GSM") antenna according to another aspect of the present disclosure.
Figure 10:
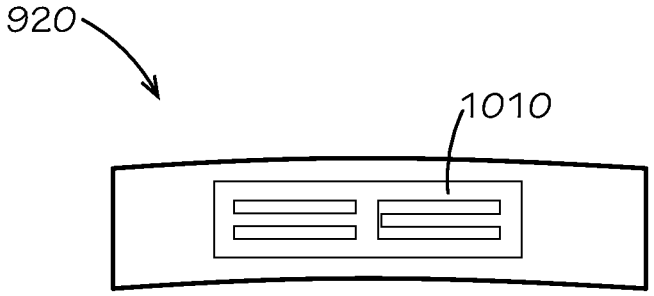
FIG. 10 is a front view of an antenna PCB strip comprising an Advanced Meter Infrastructure ("AMI") antenna according to another aspect of the present disclosure.
Figure 11:
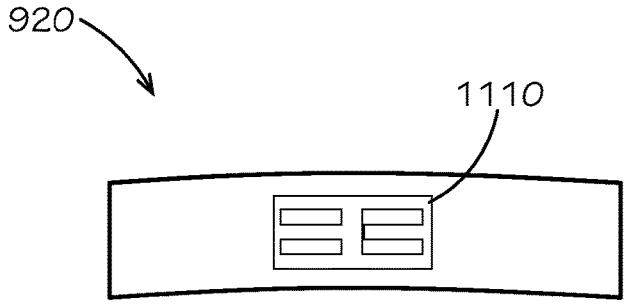
FIG. 11 is a front view of an antenna PCB strip comprising a Global Positioning System ("GPS") antenna according to another aspect of the present disclosure.
Figure 12:
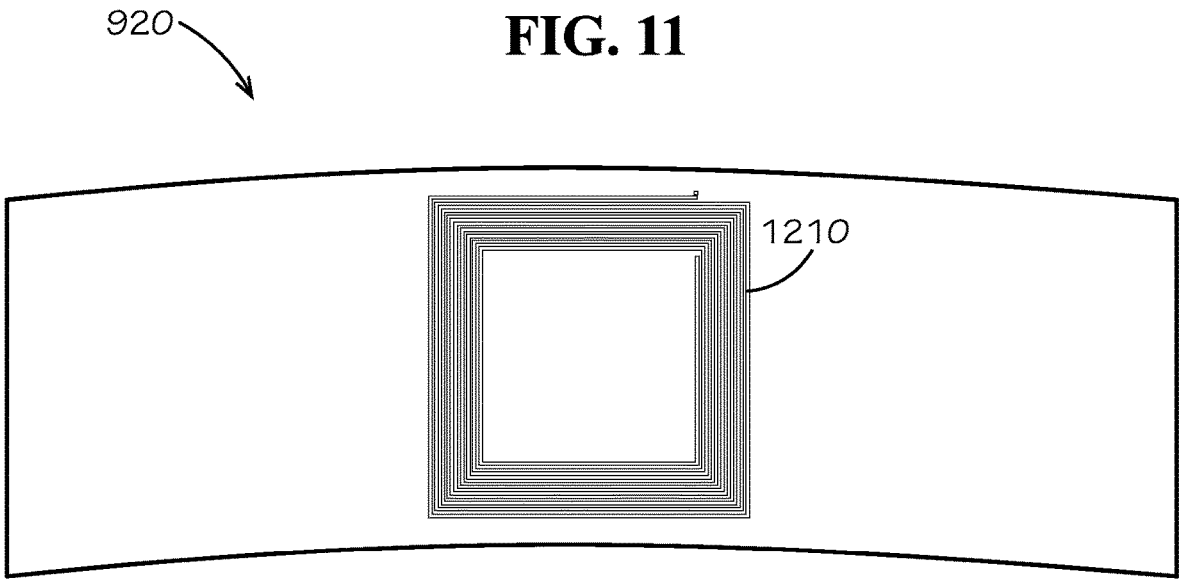
FIG. 12 is a front view of an antenna PCB strip comprising a Near Field Communication ("NFC") antenna according to another aspect of the present disclosure.

FIG. 8 is a front exploded view of the cap body 210, the plugs 452*a-c*, the pins 428*a-d*, the spacer strips 326*a,b*, the antenna PCB strips 320*a,b*, and the antenna covers 318*a,b* of the aspect of FIG. 2. The cap body 210, the pins 428*a-d*, the spacer strips 326*a,b*, and the antenna PCB strips 320*a,b* can be translated along the cap axis 201. The plugs 452*a-c* can be translated radially outward from their respective wire ports 450*a-c* relative to the cap axis 201. The coaxial cable feedlines for the antenna PCB strips 320*a,b* are not shown.

As previously described and demonstrated by the inner layer 422*a* of the antenna cover 318*a*, the inner layers 422*a,b* can be shaped complimentarily to the respective spacer strips 326*a,b*. Additionally, circumferential lengths of the antenna covers 318*a,b*, spacer strips 326*a,b*, and antenna PCB strips 320*a,b* can correspond to the circumferential length of the respective external scallop 316*a,b*. In the present aspects, the external scallop 316*a*, the antenna cover 318*a*, the antenna PCB strip 320*a*, and the spacer strip 326*a* can each define a longer circumferential length than the respective external scallop 316*b*, the antenna cover 318*b*, the antenna PCB strip 320*b*, and the spacer strip 326*b*. In other aspects, the external scallops 316*a,b*, the antenna covers

318*a,b*, the antenna PCB strips 320*a,b*, and the spacer strip 326*a,b* can be equal in circumferential length.

As previously described, the antenna PCB strips 320*a,b* can be configured to attach to the inner cover surfaces 322*a,b* within the respective covers 318*a,b* and between the respective inner layers 422*a,b* and outer layers 424*a,b*. The antenna PCB strips 320*a,b* can be flexible PCBs, and when the antenna PCB strips 320*a,b* are attached to the inner cover surfaces 322*a,b*, each antenna PCB strip 320*a,b* can be shaped as a frustum section. In other aspects, the antenna PCB strips 320*a,b* can be shaped as cylindrical sections when attached to the inner cover surfaces 322*a,b*.

The antenna PCB strips 320*a,b* can each comprise one or more antennas, as shown and further discussed below with respect to FIGS. 9-12. For example and without limitation, antenna PCB strip 320*a* can comprise two separate antennas, and a wire (shown in FIG. 4) attached to the first antenna can extend through the wire port 450*a* while a wire (shown in FIG. 4) attached to the second antenna can extend through the wire port 450*c* to attach the antenna PCB strip in electrical communication with the processing PCB 362 (shown in FIG. 3). Antenna PCB strip 320*b* can comprise a third antenna with a wire (shown in FIG. 4) extending through the wire port 450*b* to attach the antenna PCB strip in electrical communication with the processing PCB 362. In the present aspect, the antennas can be different types of antennas configured to wirelessly transmit over different frequency ranges. By separating the antenna PCB strips 320*a,b* into the separate external scallops 316*a,b*, interference between the antennas of the antenna PCB strips 320*a,b* can be reduced. By reducing interference, the separate antenna PCB strips 320*a,b* can offer improved performance in range and signal clarity. In other aspects, the nozzle cap 150 can comprise more than two antenna PCB strips 320*a,b*, and the cap body 210 can define more than two external scallops 316*a,b*.

FIGS. 9-12 show front views of variations of an antenna PCB strip 920 which can be representative of either or both of the antenna PCB strips 320*a,b*. In the aspects shown, the antenna PCB strips 920 can each comprise one antenna 910,1010,1110,1210 which can be printed on the antenna PCB strip 920. In the present aspect, the antenna PCB strips 920 can be flexible PCBs. In the aspect shown in FIG. 9, the antenna 910 can be a Global System for Mobile communication ("GSM") antenna configured to wirelessly transmit a signal over GSM frequency bands. In the aspect shown in FIG. 10, the antenna 1010 can be an Advanced Metering Infrastructure ("AMI") antenna configured to wirelessly transmit a signal over AMI frequency bands. In the aspect shown in FIG. 11, the antenna 1110 can be a Global Positioning System ("GPS") antenna configured to wirelessly transmit a signal over GPS frequency bands. In the aspect shown in FIG. 12, the antenna 1210 can be a Near Field Communication ("NFC") antenna configured to wirelessly transmit a signal over NFC frequency bands. In other aspects, the antenna PCB strip 920 can comprise one or more antennas configured to wirelessly transmit over any frequency band or range.

The antenna PCB strips 920 can define an arched shape in the present aspect; and the antenna PCB strips 920 can be curved to conform to a curvature of the inner cover surfaces 322*a,b* (shown in FIG. 8). Once secured to the inner cover surfaces 322*a,b*, the antenna PCB strips 920 can take the shape of a frustum section wherein the bottom edge and the top edge can lie in substantially parallel planes. When installed, the bottom edge can lie flat against the respective bottom cover surfaces 333*a,b* (shown in FIG. 3) in the present aspect.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A nozzle cap comprising:

a cap body defining a first body end and a second body end, the cap body defining a circumferential wall extending from the first body end towards the second body end;

an antenna cover circumferentially overlapping a scalloped portion of the circumferential wall, the antenna cover defining an inner cover surface facing the circumferential wall, an antenna cavity defined between the inner cover surface and the scalloped portion of the circumferential wall; and an antenna printed circuit board ("PCB") strip positioned within the antenna cavity, the antenna PCB strip secured in facing engagement with the inner cover surface; and wherein:

the circumferential wall defines an outer wall surface;

the scalloped portion of the circumferential wall is circumferentially positioned between a first portion of the outer wall surface and a second portion of the outer wall surface;

the scalloped portion extends inwards relative to the first portion and the second portion of the outer wall surface; and the antenna cover fits within the scalloped portion.

2. The nozzle cap of claim 1, further comprising a spacer strip positioned at least partially between the antenna cover and the circumferential wall, the spacer strip in facing engagement with each of the antenna cover and the circumferential wall.

3. The nozzle cap of claim 2, further comprising potting, the potting filling the antenna cavity, the potting at least partially positioned between the antenna PCB strip and the circumferential wall.

4. The nozzle cap of claim 1, wherein the antenna cover defines an outer cover surface, and wherein the outer cover surface is flush with the outer wall surface.

5. The nozzle cap of claim 1, wherein:
the nozzle cap comprises a pin;
the pin is secured to the cap body within the scalloped portion; and
the pin secures the antenna cover to the cap body.

6. The nozzle cap of claim 1, further comprising a cap cover attached to the first body end, the cap cover at least partially enclosing the antenna cavity.

7. The nozzle cap of claim 6, wherein:
the cap body defines a cap axis extending from the first body end to the second body end;
the cap body defines a bottom shelf at the second body end; and
the antenna cover is axially secured between the bottom shelf and the cap cover relative to the cap axis.

8. The nozzle cap of claim 1, wherein:
the antenna cover is a first antenna cover;
the antenna PCB strip is a first antenna PCB strip;
the scalloped portion is a first scalloped portion;
the antenna cavity is a first antenna cavity;
the nozzle cap further comprises a second antenna cover and a second antenna PCB strip;
the second antenna cover circumferentially covers a second scalloped portion of the circumferential wall; and
the second antenna PCB strip is disposed within a second antenna cavity defined between the second antenna cover and the second scalloped portion of the circumferential wall.

9. The nozzle cap of claim 8, wherein:
the first antenna PCB strip comprises a first antenna configured to wirelessly transmit a signal over a first frequency range;
the second antenna PCB strip comprises a second antenna configured to wireless transmit a signal over a second frequency range; and
the first frequency range is different from the second frequency range.

10. The nozzle cap of claim 1, wherein:
the cap body defines a cavity extending inwards into the cap body from the first body end towards the second body end;
the cap body defines a wire port extending through the circumferential wall to the cavity;
the antenna PCB strip comprises a wire which extends through the wire port into the cavity; and
a plug seals the wire port around the wire.

11. The nozzle cap of claim 10, further comprising a processing printed circuit board ("PCB") disposed within the cavity, the antenna PCB strip connected in electronic communication with the PCB, the antenna PCB strip comprising an antenna configured to transmit a signal from the processing PCB.

12. The nozzle cap of claim 1, wherein the antenna PCB strip is secured to the inner cover surface with an adhesive.

13. A method for installing an antenna printed circuit board ("PCB") strip in a nozzle cap, the method comprising:
attaching the antenna PCB strip to an inner cover surface of an antenna cover;
circumferentially covering a scalloped portion of a circumferential wall of a cap body of the nozzle cap with the antenna cover, the circumferential wall defining an outer wall surface and the scalloped portion, the scalloped portion being circumferentially positioned between a first portion of the outer wall surface and a second portion of the outer wall surface, the scalloped portion extending inwards relative to the first portion and the second portion of the outer wall surface, the antenna cover fitting within the scalloped portion, an antenna cavity defined between the scalloped portion of the circumferential wall and the inner cover surface of the antenna cover;
filling the antenna cavity with potting; and
securing the antenna cover to the cap body with a pin.

14. The method of claim 13, further comprising positioning a spacer strip within the antenna cavity between the antenna cover and the circumferential wall.

15. The method of claim 14, wherein positioning the spacer strip within the antenna cavity comprises adhering the spacer strip to the antenna cover.

16. The method of claim 13, further comprising positioning the antenna PCB strip between an inner layer and an outer layer of the antenna cover.

17. The method of claim 13, sealing a wire port with a plug, the wire port defined by the cap body extending through the circumferential wall, a wire of the antenna PCB strip extending through the wire port.

18. The method of claim 13, further comprising at least partially enclosing the antenna cavity with a cap cover, the cap cover attached to the cap body.

19. A nozzle cap comprising:
a cap body defining a first body end and a second body end, the cap body defining a circumferential wall extending from the first body end towards the second body end;
an antenna cover circumferentially overlapping a scalloped portion of the circumferential wall, the circumferential wall defining an outer wall surface and the scalloped portion, the scalloped portion being circumferentially positioned between a first portion of the outer wall surface and a second portion of the outer wall surface, the scalloped portion extending inwards relative to the first portion and the second portion of the outer wall surface, the antenna cover fitting within the scalloped portion, the antenna cover defining an inner cover surface facing the circumferential wall, an antenna cavity defined between the inner cover surface and the scalloped portion of the circumferential wall; and
an antenna printed circuit board ("PCB") strip positioned within the antenna cavity, the antenna PCB strip secured in facing engagement with the inner cover surface; and
wherein:
the antenna cover is a first antenna cover;
the antenna PCB strip is a first antenna PCB strip;
the scalloped portion is a first scalloped portion;
the antenna cavity is a first antenna cavity;
the nozzle cap further comprises a second antenna cover and a second antenna PCB strip;

the second antenna cover circumferentially covers a second scalloped portion of the circumferential wall; and the second antenna PCB strip is disposed within a second antenna cavity defined between the second antenna cover and the second scalloped portion of the circumferential wall.

* * * * *